United States Patent [19]

Lagow

[11] Patent Number: 4,693,087

[45] Date of Patent: Sep. 15, 1987

[54] METHOD OF GENERATING POWER FROM A VAPOR

[75] Inventor: Ralph J. Lagow, Anahuac, Tex.

[73] Assignee: Thermal Engine Technology, Inc., Houston, Tex.

[21] Appl. No.: 844,583

[22] Filed: Mar. 27, 1986

Related U.S. Application Data

[63] Continuation-in-part of Ser. No. 664,792, Oct. 25, 1984, Pat. No. 4,603,554.

[51] Int. Cl.[4] ..... F01K 11/00

[52] U.S. Cl. ..... 60/670; 60/692; 60/669

[58] Field of Search ..... 60/670, 651, 671, 669, 60/690, 692

[56] References Cited

U.S. PATENT DOCUMENTS

| | | | |
|---|---|---|---|
| 130,685 | 8/1872 | Adams | 60/670 |
| 451,342 | 4/1891 | Susini . | |
| 514,573 | 2/1894 | Susini . | |
| 670,829 | 3/1901 | Windhausen . | |
| 756,785 | 4/1904 | Fraley . | |
| 982,449 | 1/1911 | Timmins . | |
| 3,531,933 | 10/1970 | Baldwin . | |
| 3,950,949 | 4/1976 | Martin et al. . | |
| 3,967,450 | 7/1976 | Girardier . | |
| 4,018,581 | 4/1977 | Ruff et al. . | |
| 4,033,136 | 7/1977 | Stewart . | |
| 4,068,476 | 1/1978 | Kelsey . | |
| 4,102,133 | 7/1978 | Anderson . | |
| 4,106,581 | 8/1978 | West et al. . | |
| 4,109,468 | 8/1978 | Heath . | |
| 4,156,343 | 5/1979 | Stewart . | |
| 4,209,992 | 7/1980 | Chih-Kang . | |
| 4,285,201 | 8/1981 | Stewart . | |
| 4,354,565 | 10/1982 | Latter et al. . | |
| 4,424,678 | 1/1984 | Kizziah . | |
| 4,603,554 | 8/1986 | Lagow | 60/670 |

FOREIGN PATENT DOCUMENTS

| | | |
|---|---|---|
| 20771 | 5/1882 | Fed. Rep. of Germany . |
| 41477 | 4/1887 | Fed. Rep. of Germany . |
| 46619 | 5/1888 | Fed. Rep. of Germany . |
| 51433 | 6/1889 | Fed. Rep. of Germany . |
| 132091 | 3/1929 | Switzerland . |
| 140063 | 3/1919 | United Kingdom . |

*Primary Examiner*—Allen M. Ostrager

*Attorney, Agent, or Firm*—Arnold, White & Durkee

[57] ABSTRACT

There is provided a method for generating power from a working fluid wherein the working fluid is a saturated vapor or is superheated to a vapor and then passed to a high pressure zone where the working fluid is used to impart work to a working shaft by means of directly linked high and low pressure cylinder piston assemblies located in the high pressure zone and a low pressure zone, respectively. Work is imparted to the working shaft rotatably coupled to the high pressure piston by constantly exposing the lower face of the high pressure piston to the vapor in the high pressure zone while selectively exposing the upper face of the high pressure piston to the vapor in the high pressure zone as the high pressure piston approaches upper dead center in relation to the working shaft, said upper face of the high pressure piston forming a first variable volume with the high pressure cylinder wall; and concurrently therewith intermittently discharging vapor from the first variable volume to a larger second variable volume formed of the lower face of a low pressure piston linked directly to the high pressure piston and a low pressure cylinder wall while constantly exposing the upper face of the low pressure piston to low pressure vapor in a low pressure zone and intermittently exposing the second variable volume to the low pressure zone, said second variable volume being allowed to increase more rapidly than the first variable volume decreases as the high and low pressure pistons move from bottom dead center to top dead center in relation to the working shaft.

65 Claims, 17 Drawing Figures

FIG.7
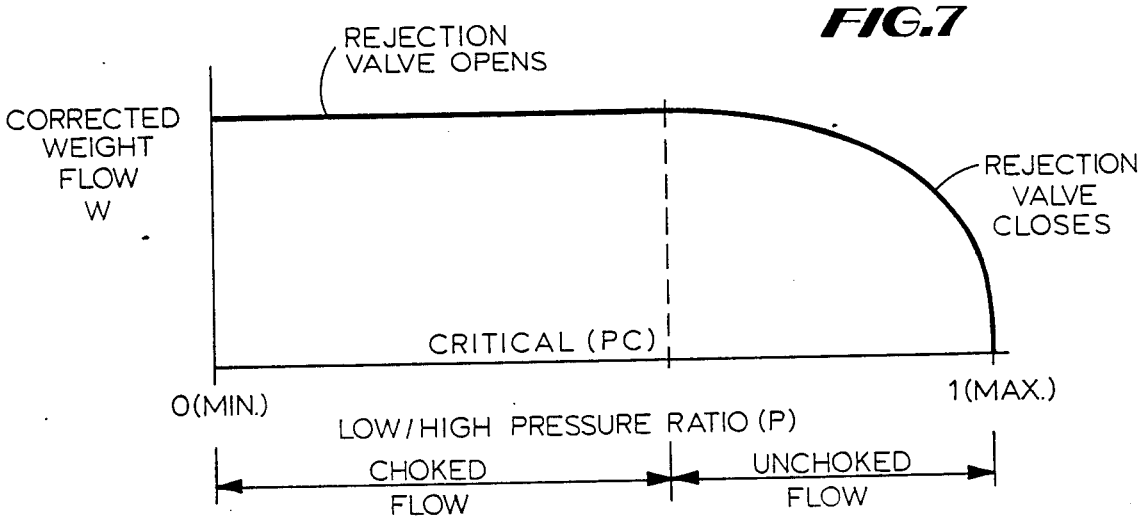
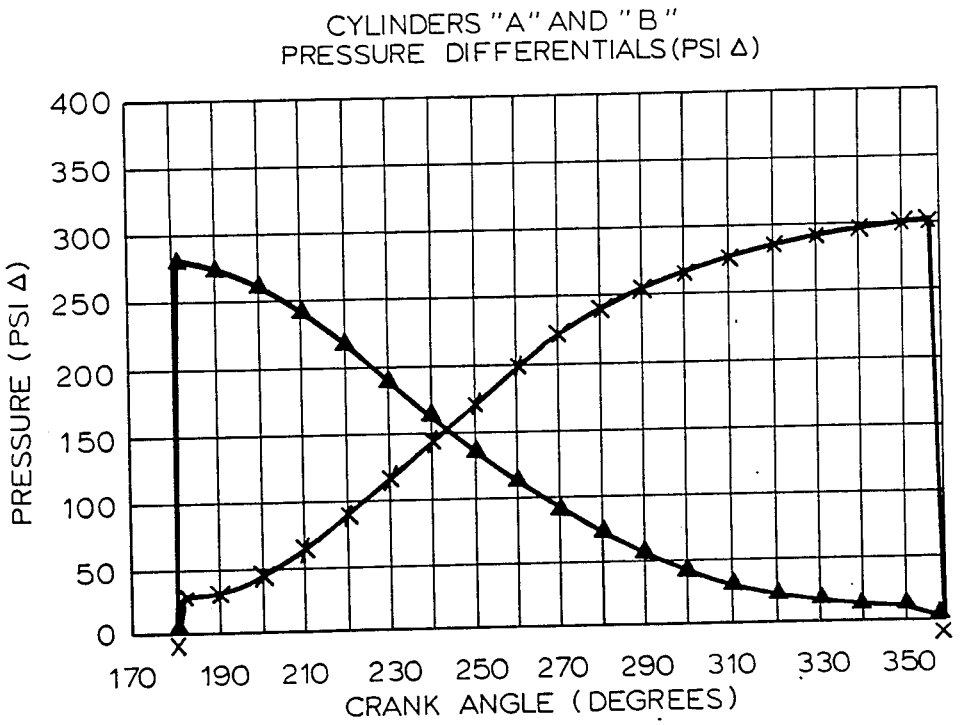
LEGEND:
X = Δ PA
▲ = Δ PB
FIG.8

FIG.12
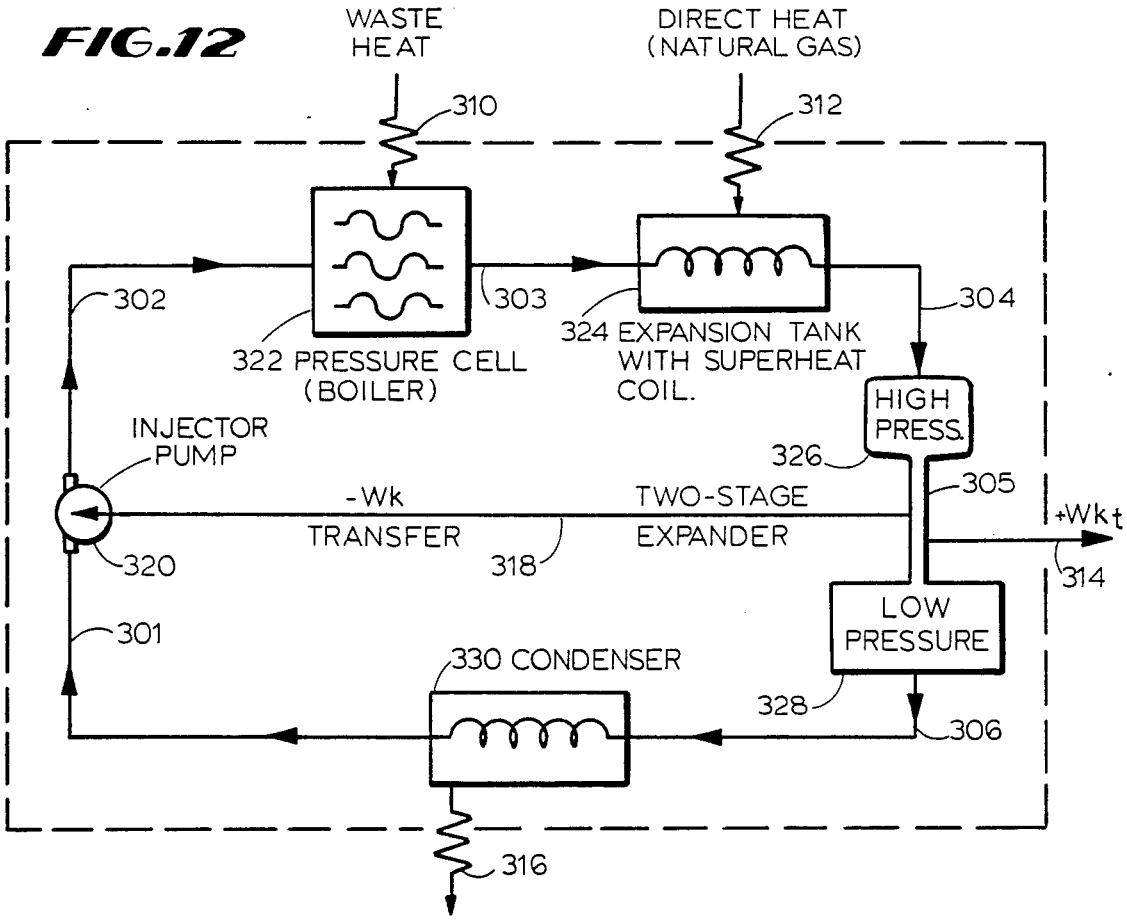
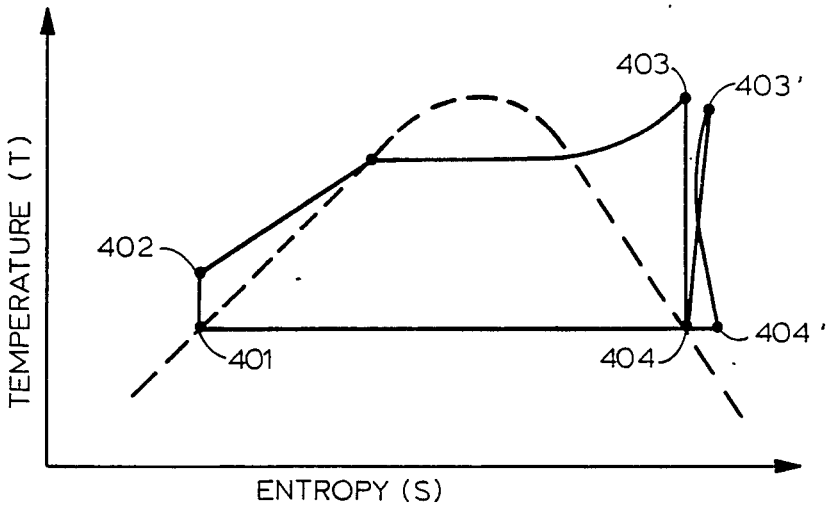
FIG.13

METHOD OF GENERATING POWER FROM A VAPOR

This is a continuation-in-part of a patent application, Ser. No. 664,792 filed Oct. 25, 1984 and entitled IMPROVED METHOD AND APPARATUS FOR EXTRACTING USEFUL ENERGY FROM A SUPERHEATED VAPOR ACTUATED POWER GENERATING DEVICE, now U.S. Pat. No. 4,603,554.

BACKGROUND OF THE INVENTION

The past two hundred years have seen the development of numerous work-producing devices or heat engines. Among these are internal combustion engines such as the diesel engine or cycle, the gasoline engine or Otto cycle and the Wankel rotary engine as well as turbines such as the steam turbine engine or the Rankine cycle and the gas turbine engine or Brayton cycle. The Stirling engine and other cycles have also been defined.

Many work-producing devices or engines utilize a working fluid in the form of a gas. The spark-ignition automotive engine is a familiar example, and the same is true of the diesel engine and the conventional gas turbine. In all of these engines there is a change in composition of the working fluid, because during combustion it changes from air and fuel to combustion products. For this reason these engines are called internal combustion engines. In contrast to this the steam power plant may be called an external-combustion engine, because heat is transferred from the products of combustion to the working fluid. These external-combustion engines or cycles undergo a variety of processes including compression or expansion at varying conditions in order to produce work. The cycles are often defined in terms of these processes. For example, the working fluid in the Rankine cycle ideally undergoes the following steps: a reversible adiabatic pumping process in a pump; a constant-pressure transfer of heat in a boiler; a reversible adiabatic expansion in the turbine or other prime mover such as a steam engine; and a constant-pressure transfer of heat in a condenser.

In the Stirling cycle the heat is transferred to a working fluid during a constant-volume process followed by further heat transfer during an isothermal expansion process. Heat is then rejected during a constant volume process and further during an isothermal compression process.

The most efficient ideal process is the Carnot cycle, which defines the most efficient engine that can be operated between a high temperature and a low temperature reservoir. The Carnot cycle always involves four basic steps, namely: a reversible isothermal process in which heat is transferred to or from the high temperature reservoir; a reversible adiabatic process in which the temperature of the working fluid decreases from the high temperature to the low temperature; a reversible isothermal process in which heat is transferred to or from the low temperature reservoir; and a reversible adiabatic process in which the temperature of the working fluid increases from the low temperature to the high temperature.

In practice all heat engines fall short of ideal performance. This is due to a variety of factors including pressure drops along piping or tubing, heat losses through piping or other surfaces and deviations of the working fluid from the ideal as well as frictional, rotational and other losses, such as due to leakage. Further inefficiencies can result from the configuration of the particular process. These may include one or more of several inefficiencies for a given cycle or engine. For example, many devices fail to develop a sufficient mean effective pressure. Here, the term "mean effective pressure" may be defined as the pressure which, if acted on a piston during the entire power stroke, would do an amount of work equal to that actually done on the piston. The work for one cycle is found by multiplying this mean effective pressure by the area of the piston and by the stroke's length.

In other devices the maximum pressure differential occurs at less than favorable crank angles for exerting forces on the offset of the crank shaft. As such, there is produced a limited amount of energy at the torque producing position(s) of the crank angle. For example, the maximum pressure differential may occur at or near dead center of the piston's travel with concomitant poor crank angle position to produce torque.

Other devices or methods require relatively high operational temperature requirements. Still other methods and devices have limited thermal efficiency in relation to the Carnot cycle. Other devices and methods require relatively high mass flow per unit of power produced, while others suffer from inefficient fuel consumption and incomplete fuel combustion. Other devices and methods have lower efficiencies under partial loads or at lower speeds while others suffer energy losses due to condensation. Still other devices and methods are relatively complex and hence expensive to operate.

These and other shortcomings of the prior devices, including internal and external combustion engines, are alleviated if not eliminated by the present method and apparatus.

SUMMARY OF THE INVENTION

There is provided an external combustion process for generating power. A super heated vapor is generated from a working fluid. The super heated vapor is then passed to a high pressure zone having a high pressure cylinder and piston operably connected to a working shaft. An isolated subvolume of working fluid is formed in the high pressure cylinder. The subvolume of working fluid is then constantly decreased in the high pressure cylinder by discharging the subvolume to a low pressure cylinder and piston assembly located in a low pressure zone to constantly increase the subvolume of working fluid in the low pressure cylinder.

In another embodiment a superheated vapor is generated from a working fluid. The superheated vapor is then supplied to a high pressure zone to maintain the high pressure zone at a substantially constant high pressure. Thereafter work is imparted to a working shaft which is rotatably coupled to a high pressure piston. This is done by constantly exposing the lower face of the high pressure piston to the vapor in the high pressure zone while selectively exposing the upper face of the high pressure piston to the vapor in the high pressure zone as the high pressure piston approaches upper dead center in relation to the working shaft. The upper face of the high pressure piston forms a first variable volume with the high pressure cylinder wall.

Concurrently with imparting work to the working shaft vapor is intermittently discharged from the first variable volume to a larger second variable volume formed of the lower face of a low pressure piston linked directly to the high pressure piston and a low pressure cylinder wall. Concurrently therewith the upper face of the low pressure piston is constantly exposed to low pressure vapor in a low pressure zone and the second variable volume is intermittently exposed to the low pressure zone. The second variable volume is allowed to increase more rapidly than the first variable volume decreases as the high and low pressure pistons move from bottom dead center to top dead center in relation to the working shafts.

The high pressure vapor in the first variable volume preferably generally undergoes an adiabatic isentropic expansion as the vapor is intermittently discharged from the first variable volume to the second variable volume. The vapor in the high pressure zone impacting the lower face of the high pressure piston perfoms a preferably generally isobaric work process as the vapor is intermittently discharged from the first variable volume to the second variable volume. The step of generating a superheated vapor preferably comprises heating the condensed vapor from the low pressure zone using a low grade heat source sufficiently to cause the condensed vapor to undergo a phase change to saturated vapor and thereafter by additionally heating the saturated vapor while exposing it to another heat source such as a high grade heat to form the superheated vapor.

In another embodiment there is provided a process for generating power including the steps of generating a superheated vapor from a working fluid and supplying a superheated vapor to a high pressure zone to maintain the high pressure zone at a substantially constant high pressure. Work is then first imparted to a working shaft coupled to a high pressure piston by placing a first variable volume comprising the lower face to the high pressure piston and the high pressure cylinder walls in fluid communication with the high pressure zone while allowing discharge of working fluid from a second variable volume formed from the upper face of the high pressure piston and the high pressure cylinder walls to a third variable volume formed by the lower face of a low pressure piston linked to the high pressure piston and low pressure cylinder walls while concurrently therewith placing a fourth variable volume including the upper face of the low pressure piston and the low pressure cylinder walls to a low pressure zone. The low pressure zone is maintained at a substantially constant low pressure. Thereafter, work is further imparted to the working shaft by placing the second variable volume in fluid communication with the high pressure zone while allowing discharge of working fluid from the first variable volume to the fourth variable volume and concurrently placing the third variable volume in fluid communication with the low pressure zone.

The working shaft is operably connected to a high pressure piston by a crank mechanism rotating through 360 degrees. The high pressure piston preferably attains a high mean effective pressure as the crank mechanism approaches the optimum angle for exerting force on the crank mechanism.

A mechanism for the recycle of working fluid may also provided. For example, where the low pressure zone also functions as a condenser, during the foregoing operation an injector piston may preferably serve to return condensed working fluid coming from a conduit, such as a suction tube, in fluid communication with the condensed working fluid in the low pressure zone.

BRIEF DESCRIPTION OF THE DRAWINGS

FIG. 7 is a diagram of flow sections;

FIG. 8 is a graph of pressure vs. crank angle for incremental changes in pressure in high and low pressure cylinders;

FIG. 12 is a closed system energy association diagram generally depicting the operation of the embodiment shown in FIGS. 9–11;

FIG. 13 is a thermodynamic process cycle generally plotting temperature versus entropy for the embodiment depicted in FIGS. 9–11;

DETAILED DESCRIPTION

Figure 9:
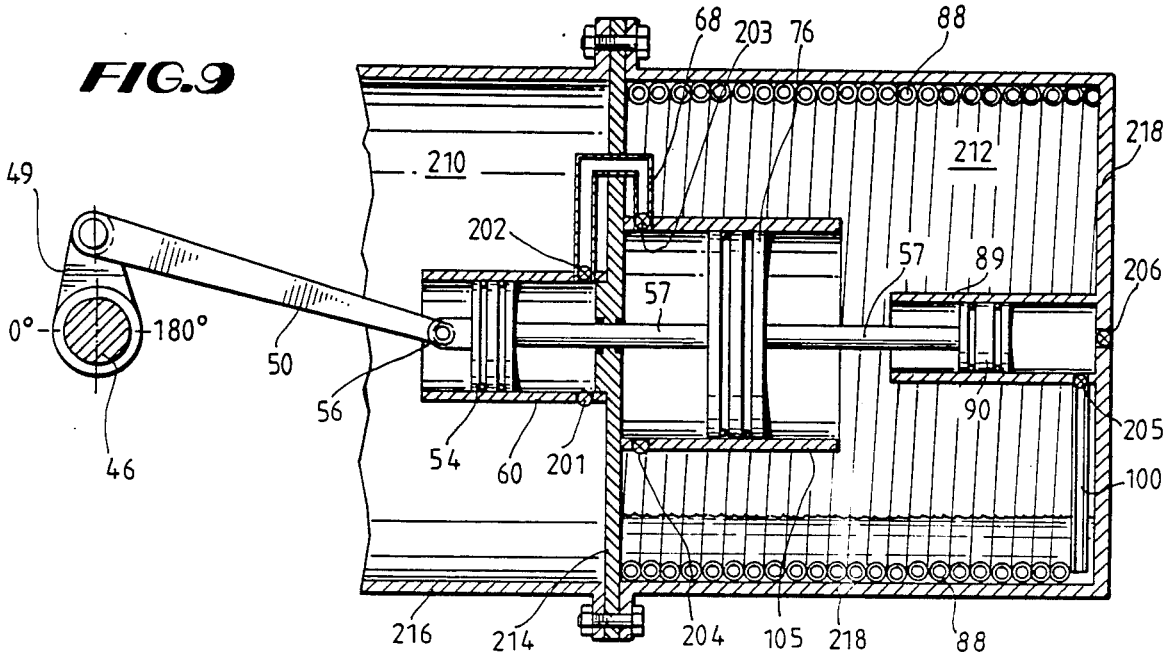
FIG. 9 is a partial schematic view of a vapor power actuated generating system according to the present disclosure.
Figure 10:
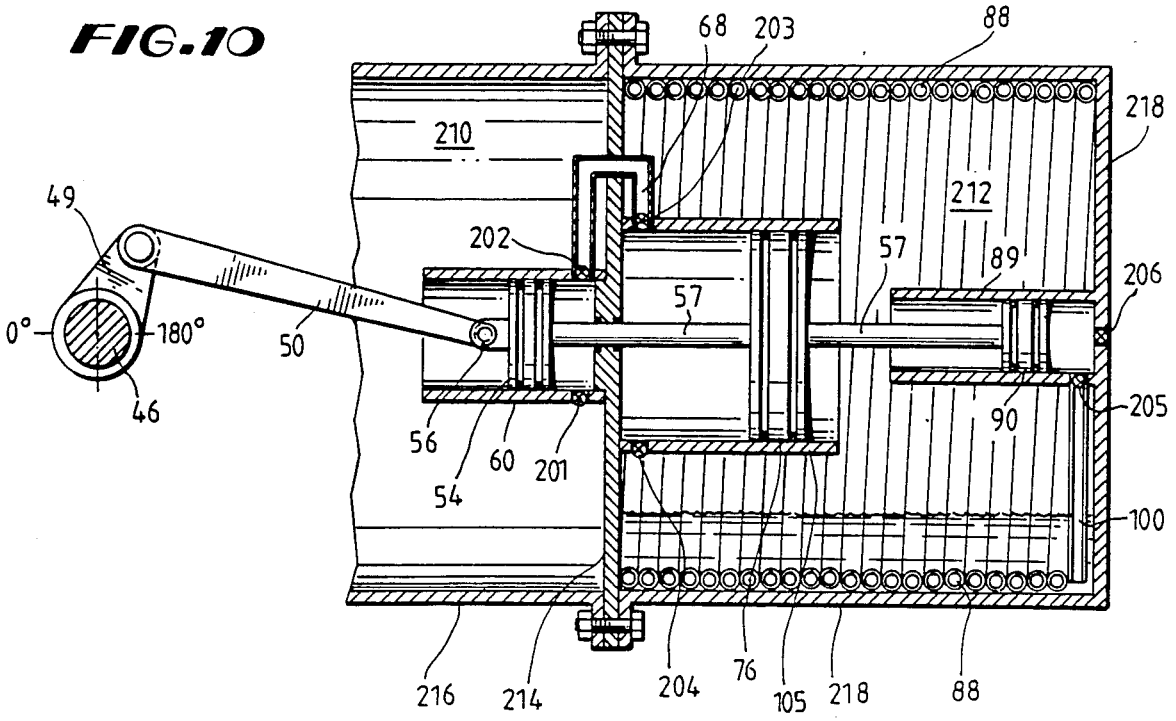
FIGS. 10–11 are schematic representations according to FIG. 9, but with certain elements shown in different positions.
Figure 11:
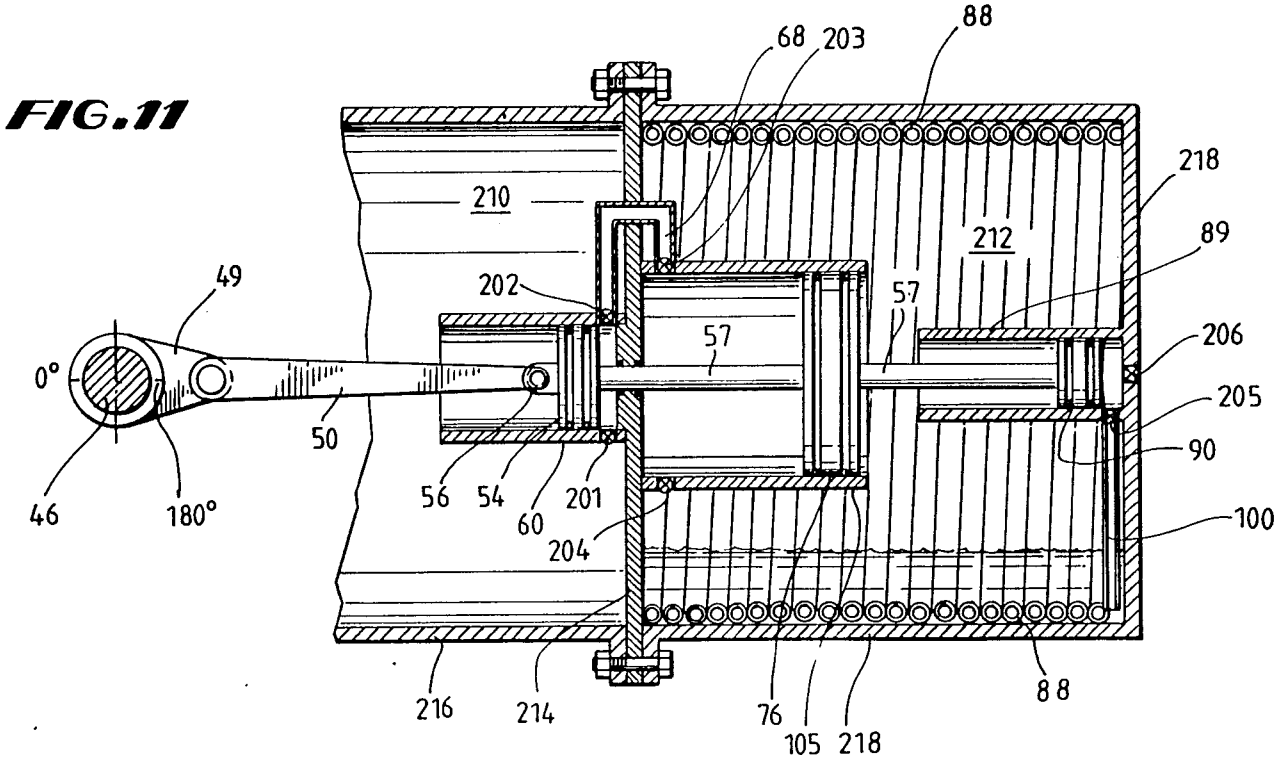

Referring generally to FIGS. 9–11, there is shown a schematic view of one general embodiment of the present method. A high pressure piston cylinder assembly including high pressure piston 54 and high pressure cylinder 60 is mounted on partition wall 214. A low pressure piston cylinder assembly including a low pressure piston 76 and low pressure cylinder 105 is mounted on the opposite side of wall 214. The high and low pressure piston cylinder assemblies are placed in intermittent selective fluid communication by discharge conduit 68 and discharge valve 202 and intake valve 203. The high pressure piston is directly linked to the low pressure piston by piston rod 57, which sealingly passes through insulated partition wall 214. High pressure reservoir or zone 210 is formed from exterior insulated wall 216 and interior partition wall 214. Low pressure reservoir or zone 212 is formed from another exterior insulated wall 218 and interior insulated wall 214. The lower face of high pressure piston 54 is constantly exposed to high pressure reservoir zone 210, while the upper face of low pressure piston 76 is constantly exposed to low pressure reservoir 212.

The high pressure cylinder 60 and the upper face of high pressure piston 54 form a first variable volume, while the low pressure cylinder 105 and the lower face of low pressure piston 76 form a second variable volume. The first variable volume is selectively in fluid communication with the second variable volume by means of discharge conduit 68, discharge valve 202, and intake valve 203. Similarly, the first and second variable volumes are in selective fluid communication with low pressure reservoir 210 and high pressure reservoir 212, respectively, by means of intake valve 201 and discharge valve 204.

Low pressure reservoir 212 is encircled by working coil 88 such that low pressure reservoir 212 acts as a condenser for working fluid being discharged through discharge valve 204. Condensed working fluid is drawn up through conduit 100 and through intake valve 205 and discharge valve 206 by means of a discharge cylinder-piston assembly formed from cylinder 89 and piston 90. Piston 90 is in turn directly linked by rod 57 to low pressure piston 76 and high pressure piston 54, such that the three pistons act in tandem.

The lower face of high pressure piston 54 is operably linked to a working shaft such as output shaft 46 by means of a connecting rod 50 and yoke assembly 49. As indicated in FIGS. 9–11, movement of the high pressure piston 54 from left to right (as shown in the drawings) and back rotates the shaft 46.

As indicated generally in FIGS. 9–11, the low pressure cylinder and piston assembly is considerably larger than the high pressure piston and cylinder assembly. It is definitely preferable that the second variable volume has a larger volume than the first variable volume. By way of example, the low pressure cylinder diameter should preferably be at least twice the diameter of the high pressure cylinder diameter. It sometimes may be three or more times the diameter, though it may be beneficial to add a second low pressure piston and cylinder assembly rather than further expand the diameter of one low pressure cylinder.

In operation, high pressure piston 54 and low pressure piston 76 begin operation at 0 degrees when the high and low pressure pistons are inside dead center in relation to the working shaft 46 as shown in FIG. 9. At this juncture discharge valve 202 and intake valve 203 are closed, while intake valve 201 is open to allow high pressure vapor to enter the first variable volume. Once high pressure working fluid has entered the first variable volume then intake valve 201 is closed and discharge valve 202 and intake valve 203 are opened, thus placing the first and second variable volumes in fluid communication through discharge conduit 68. As the upper face of low pressure piston 76 is exposed to the low pressure working fluid in low pressure reservoir 212, while the lower face of piston 76 is exposed to a relatively high pressure due to the opening of discharge valve 202 and intake valve 203 and the closing of intake valve 201, the change in pressure or pressure differential across the two faces of piston 76 drives the low pressure piston 76 away from inside dead center, thus also forcing high pressure piston 54 away from inside dead center. The movement of high pressure piston 54 and low pressure piston 76 away from inside dead center, as shown in FIG. 10, represents the power stroke. At this point in time exhaust valve 204 is closed.

As the working fluid decreasing in pressure enters the second variable volume by way of discharge conduit 68, the high pressure working fluid in the high pressure reservoir 210 acts on the lower face of high pressure piston 54 and serves to also drive high pressure piston 54 away from inside dead center, thus contributing to the power stroke. At this point in time intake valve 201 is closed.

As shown in FIG. 11, the high pressure piston 54 and the low pressure piston 76 subsequently approach 180 degrees or outside dead center. Exhaust valve 202 and intake valve 203 are closed, thus cutting off discharge conduit 68, while intake valve 201 and discharge valve 204 are opened, thus bringing the first and second variable volumes into fluid communication with the high and low pressure reservoirs 210 and 212, respectively. High pressure piston 54 and low pressure piston 76 then travel from outside dead center back to inside dead center (or from 180 degrees to 360 degrees), due to the momentum of an opposing cylinder bank connected through connecting rod 50 or another connecting rod thus preparing for another power stroke.

A mechanism for the recycle of working fluid is also provided. For example, during a foregoing operation an injector piston 90 may preferably serve to return condensed working fluid coming from a conduit, such as a suction tube 100, in fluid communication with the condensed working fluid in the low pressure reservoir 212. As the high pressure and low pressure pistons 54 and 76 move from inside dead center to outside dead center or from 0 to 180 degrees, the condensed fluid is pumped through discharge valve 206 for recycle and use in the system. As the high and low pressure pistons 54 and 76 move from inside dead center to outside dead center or from 180 to 360 degrees, condensed fluid is drawn into the volume formed by the upper face of injector piston 90 and the injector piston walls or sleeve 89. This condensed working fluid is then discharged on the next power stroke as the pistons move from inside dead center to outside dead center or from 0 to 180 degrees.

The foregoing embodiment depicted in FIGS. 9–11 may be used advantageously with a low-grade heat source, such as waste heat. For example, systems designed for the industrial cogeneration market could make use of waste heat from industrial facilities which is transferred by means of water flowing through a heat absorption loop and then into a heating coil located in a high pressure saturated vapor generating cell such as a boiler. The heating coil could be submersed in a liquid reservoir of the systems working fluid, such as a refrigerant. At this point, the liquid working fluid, such as Freon 22 (R-22), absorbs heat from the heating coil and undergoes a phase change to a saturated vapor. The saturated vapor then flows to an expansion tank with super heated coil, which adds heat isobarically, generating a superheated vapor of the working fluid. The superheated vapor could then enter the high pressure reservoir 210 for use in the system as already discussed.

Although not wishing to be held to any particular theory, the process disclosed herein may be viewed thermodynamically in conjunction with FIG. 12 and a temperature entropy diagram shown schematically in FIG. 13. Referring generally to FIG. 12, and by analogy to FIGS. 9–11, an injector pump 320 is in fluid communication with a boiler or pressure cell 322 which receives waste heat as indicated at 310 to heat working fluid. Working fluid heated in boiler 322 then passes via line 303 to expansion tank 324 where it comes into thermal contact with a direct heat such as from natural gas as indicated at 312 to form a superheated vapor. The superheated vapor then passes via line 304 to high pressure cylinder-piston assembly 326 and then via line 305 to low pressure cylinder-piston assembly 328 to produce work as indicated by lines 314 and 318. The spent working fluid then passes via line 306 to be condensed in condenser 330 by giving up heat as indicated by line 316. The condensed working fluid is then recycled via line 301 to injector pump 320.

In the injector pump 320 there occurs an isentropic compression of liquid. This is shown in FIG. 13 from points 401 to 402. This is followed by a constant pressure or isobaric heat addition in the expansion tank with the superheat coil 324 and essentially occurs between points 402 and 403 on the entropy temperature diagram. Thereafter between points 403 and 404 there is an isentropic expansion of the vaporized working fluid in the high pressure cylinder 326 allowing an isobaric work process to be produced by the piston contained in cylinder 326. There also occurs nearly simultaneously at this point a rapid isentropic compression followed by an isentropic expansion of vapor in the low pressure cylinder 328 as shown by lines 404 to 403 prime (403') to 404 prime (404'). These steps are followed by a constant pressure or isobaric heat rejection from steps 404 prime (404') through 404 to 401 occurring in condenser 330.

Figure 14:
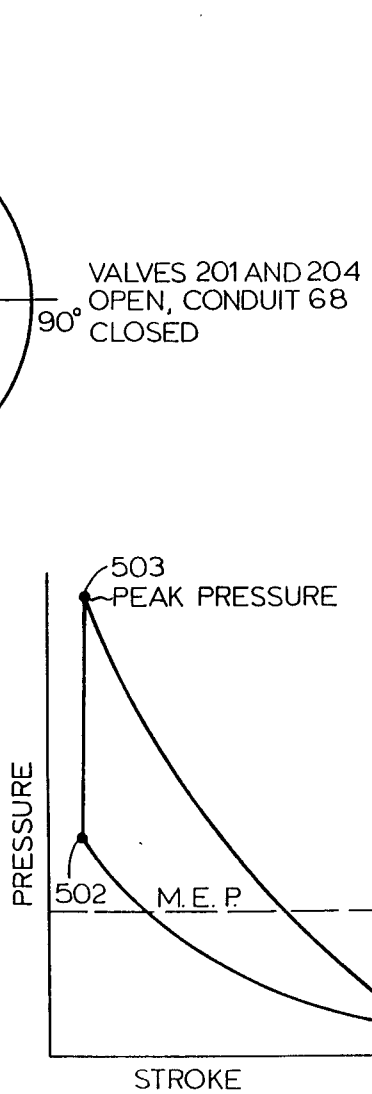
FIG.14 (PRIOR ART)
FIG. 14 is an indicator diagram for an internal combustion engine.

An indicator diagram may serve to further describe the process. Referring to FIG. 14 there is shown a schematic of an indicator diagram with pressure graphed against stroke position for a internal combustion engine. During the suction phase of the internal combustion cycle an inlet valve is open and a gas mixture fills a cylinder volume as the piston moves to the bottom of dead center. The gas volume is now at a maximum and the pressure remains close to ambient pressure as indicated at point 501. The inlet valve then closes and the compression stroke moves the piston to top dead center, the gas volume has decreased and the pressure increased such that we are now at point 502 on the indicator diagram, FIG. 14. The area enclosed by the horizontal stroke-axis and the vertical lines from the axis to points 501 and 502 is a measure of the compression work required to get to point 502. At this point the mixture is ignited which results in heat energy released to the gas mixture, which is sufficiently rapid that the volume remains practically unchanged while the pressure increases thus bringing the process to point 503. The piston is now forced down to bottom dead center and the pressure drops as the volume increases thus moving the process to point 504 on the indicator diagram, FIG. 14. The area enclosed between the curve 503-504 and the horizontal stroke-axis is a measure of the work produced during the expansion stroke and the net area inside lines 501–504 is a measure of the net work produced during the cycle. The mean effective pressure is defined as the area enclosed by the contour of lines 501–504 divided by the stroke or swept volume.

Figure 15:
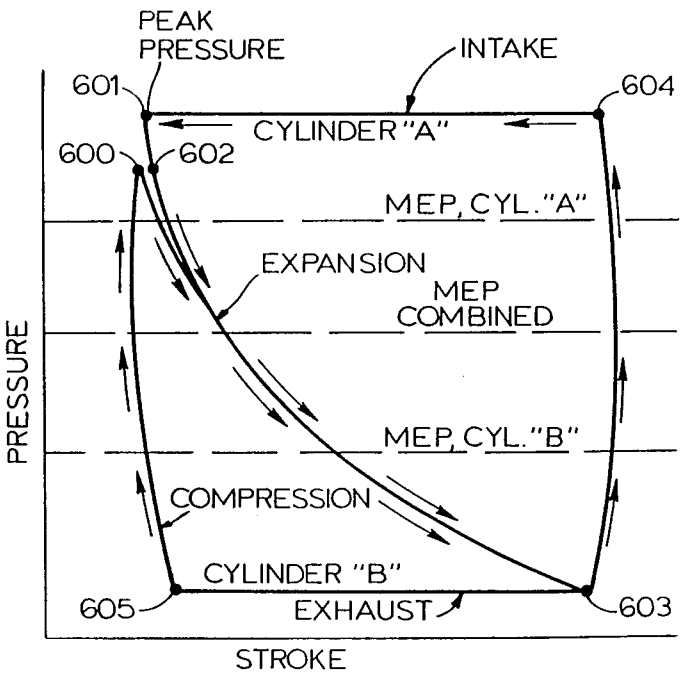
FIG. 15 is a schematic of an indicator diagram for the embodiment disclosed in FIGS. 9–11.

Referring now to FIG. 15, there is shown a general schematic of an indicator diagram with pressure graphed against stroke for both the high and low pressure cylinders, respectively, of the foregoing embodiment. Just prior to the high pressure piston begining its power stroke the pressure is at its peak in the high pressure cylinder. This puts the process at point 601 in the high pressure cylinder. Concurrently, in the low pressure piston just prior to the beginning its power stroke the pressure is at its minimum in the low pressure cylinder thus putting the process at point 604 in the low pressure cylinder. Immediately upon the opening of the valves allowing the volume of high pressure fluid contained in the high pressure cylinder to communicate with the volume of low pressure fluid contained in the low pressure cylinder, the process in the high pressure cylinder moves to point 602 and the process in the low pressure cylinder due to compression intake moves from point 605 to 606. As the direction of motion to outside dead center continues a drop in the high pressure occurs as the expansion process between the high pressure piston and the low pressure piston proceeds until the low pressure point 603 is reached by both pistons. Upon reaching outside dead center, the valves allowing communication between the high pressure piston and the low pressure piston close. The direction of motion to inside dead center is begun simultaneously with the opening of the high pressure intake valve of the high pressure cylinder such that the compression process moves from point 603 to point 604. An intake process proceeds to point 601 as the high pressure cylinder fills with high pressure fluid until the high pressure piston reaches inside dead center where upon reaching that point 601 the high pressure intake valve closes. Concurrently with movement of the high pressure piston the low pressure piston in the low pressure cylinder is in equilibrium with approximately equal pressures on both its upper and lower faces. Simultaneous with its motion to inside dead center the exhaust valve of the low pressure cylinder opens and is discharged in a constant pressure process until point 605 is reached when the low pressure piston reaches inside dead center. Upon reaching inside dead center with the low pressure piston at point 605 and the exhaust valve closed and the high pressure piston at point 601 with the intake valve closed, the cyclic process is completed and another cycle is ready to begin.

As the embodiment shown uses both a high pressure cylinder piston assembly and a low pressure cylinder piston assembly there are two mean effective pressures produced, one in the low pressure cylinder and one in the high pressure cylinder. It is believed that the combined mean effective pressure will be significantly above that of other processes using a single piston and cylinder assembly. Thus, although the mean effective pressure of the low pressure piston may be lower than other cycles it is believed that the combined mean effective pressure for the process will be better than the mean effective pressure for other cycles, thus resulting in greater efficiency or a better use of the available forces.

The process described in conjunction with the foregoing also is believed to apply a greater pressure at a more favorable crank angle for exerting forces on the offset of the crankshaft. In the internal combustion engine, the fuel-air mixture is admitted into the cylinder at or near top dead center and when ignition occurs, a good portion of the piston force is transmitted directly to the bearing of the main crankshaft as the piston moves downward and the torque producing leverage arm increases, the cylinder volume steadily increases with both pressure and temperature dropping as the superheated high pressure vapor expands.

In the foregoing design, the high pressure cylinder is housed in a pressure chamber filled with high pressure superheated vapor and has a volume which is large relatively to the high pressure cylinder volume. This high pressure remains constant during the stroke from piston bottom dead center to top dead center. The high pressure superheated volume is admitted to the inside of the high pressure cylinder during the stroke of the piston from top dead center to bottom dead center. Then as the piston moves back to top dead center, the exhaust valves open on the high pressure cylinder, allowing the superheated vapor to flow through the vapor transfer lines which communicate directly with the low pressure cylinder located inside the low pressure reservoir which is also the system condenser. Since the volume of the low pressure cylinder is much greater than the combined volumes of the high pressure cylinder and its related vapor transfer lines to the low pressure cylinder, superheated vapor can be expanded during most of the power stroke to the maximum low pressure of the system.

The pistons in both the high and low pressure cylinder assemblies are directly linked so that their direction and speed are identical. Owing to the direct linkage with the bottom face of the high pressure piston constantly exposed to the maximum high pressure of the system and the top face of the low pressure piston constantly exposed to the minimum low pressure of the system, the maximum pressure differential across the piston assembly can be achieved for the maximum duration and at the most advantageous torque arm positions resulting in a higher mean effective pressure and better use of available forces.

The foregoing process can also provide an advantage in that it is believed to have a thermodynamic efficiency (which may be defined as the conversion efficiency of heat energy into mechanical energy) greater than 0 throughout most of its power stroke as the pistons move from just above 0 to 180 degrees. For example, as would be known to one skilled in the art having the benefit of this disclosure, the steam Rankine cycle initially has a zero efficiency as the piston moves through the initial phase of the power stroke. Although work is being done in this initial phase in the steam Rankine cycle, there is no expansion or change in heat content and so no thermal efficiency. In contrast in the present process as described above, expansion of gas occurs early in the power stroke upon the opening of the discharge conduit 68. By way of example it is believed that the process as described above allows the conversion of thermal energy to work during the power stroke's rotational time interval of about 2 degrees to almost 180 degrees, while a steam Rankine cycle might result in the conversion of heat to work during the power stroke's rotational time interval of about 60 to about 180 degrees.

The foregoing process also provides an advantage in that it produces work in two cylinders from a single volume of working fluid as the two pistons go through the same 180 degree working cycle. Prior processes have employed separate mass volumes supplied to each cylinder to produce work from a number of cylinders. The multi-cylinder internal combustion engine is a typical example with working fluid supplied separately to each cylinder. Additionally, a double expansion steam engine uses a single mass to supply two cylinders, but only as the cylinder goes through different 180 degree cycles. In contrast, the two cylinders as described above produce work from a single volume of working fluid as the two cylinders go through the same 180 degree working cycle thus resulting in better efficiency or a better use of available forces.

In operation the foregoing process can be conducted under a range of conditions depending upon the working fluid and other circumstances. By way of example, but not limitation, superheated vapor may generally be used as a working fluid at less than or equal to 400 degrees F. For example, if Freon 22 is used as the working fluid, the process may be operated between 35° F. as a low temperature and 270° F. as a high temperature.

It is believed that for a given process the same efficiency may be maintained over a wide range of temperatures. In actual as opposed to ideal practice the condenser temperature would be expected to remain constant, but the vapor temperature could vary. If the vapor temperature drops such that the full expansion in the low pressure cylinder is completed before the end of the stroke, an equalizing valve such as valve 204 (see FIG. 9) could be opened to prevent a vacuum being drawn. Of if the vapor temperature increases such that the fluid expansion cannot take place in the low pressure cylinder, then the equalizing valves such as valves 201 and 204 (see FIG. 9) could remain open and valves 202 and 203 remain closed in both the high pressure and low pressure cylinders during the power stroke until just enough working fluid is left in the high pressure cylinder for a complete expansion in the low pressure cylinder. Also, running at part load with the same efficiency as full load can be accomplished by delaying the closing of the high pressure cylinder equalizing valve such as valve 201 (FIG. 9) and advancing the opening of the low pressure cylinder equalizing valve such as valve 204 (FIG. 9) while valves 202 and 203 remain closed.

Pressures may also vary depending upon the working fluid and other circumstances. For example in some instances a maximum pressure may be 700 psig. In other instances the maximum pressure may range from 300 to 400 psig. Of course, pressures throughout the system will vary with time and location, as will the mean effective pressure. By way of example, but not by way of limitation, in one case the high pressure cylinder may be at a pressure of 221 psig while the low pressure cylinder may be at a pressure of 91 psig with the mean effective pressure being approximately 112 psig.

As with pressure and temperature, it is believed that the revolutions per minute will be relatively low. For example, it is believed that the system as described above may generally be operated at less than 1200 rpms. For example, it is believed that it may be operated at 450 rpms or less.

A wide range of working fluids are believed to be useable in conjunction with the foregoing process as would be known to one skilled in the art having the benefit of this disclosure. For example, a wide range of refrigerants, such as Freon 22, may be used. In more exotic applications, such as if the engine is used for space applications, a working fluid such as an alkylated aromatic like Dowtherm J marketed by Dow Chemical Co. may be employed. Other working fluids may generally include various man-made and naturally occuring refrigerents and/or coolants such as water which are capable of changing phases.

In construction it is believed that a wide range of materials may be used in building the foregoing engine. However, it is preferable that the elements are strong and light weight such as carbon fibers and ceramics. For example, a ceramic insulating material such as Cerro-Plasmic may be used in wall 214 to thermally isolate the low pressure reservoir from the high pressure reservoir.

Figure 1:
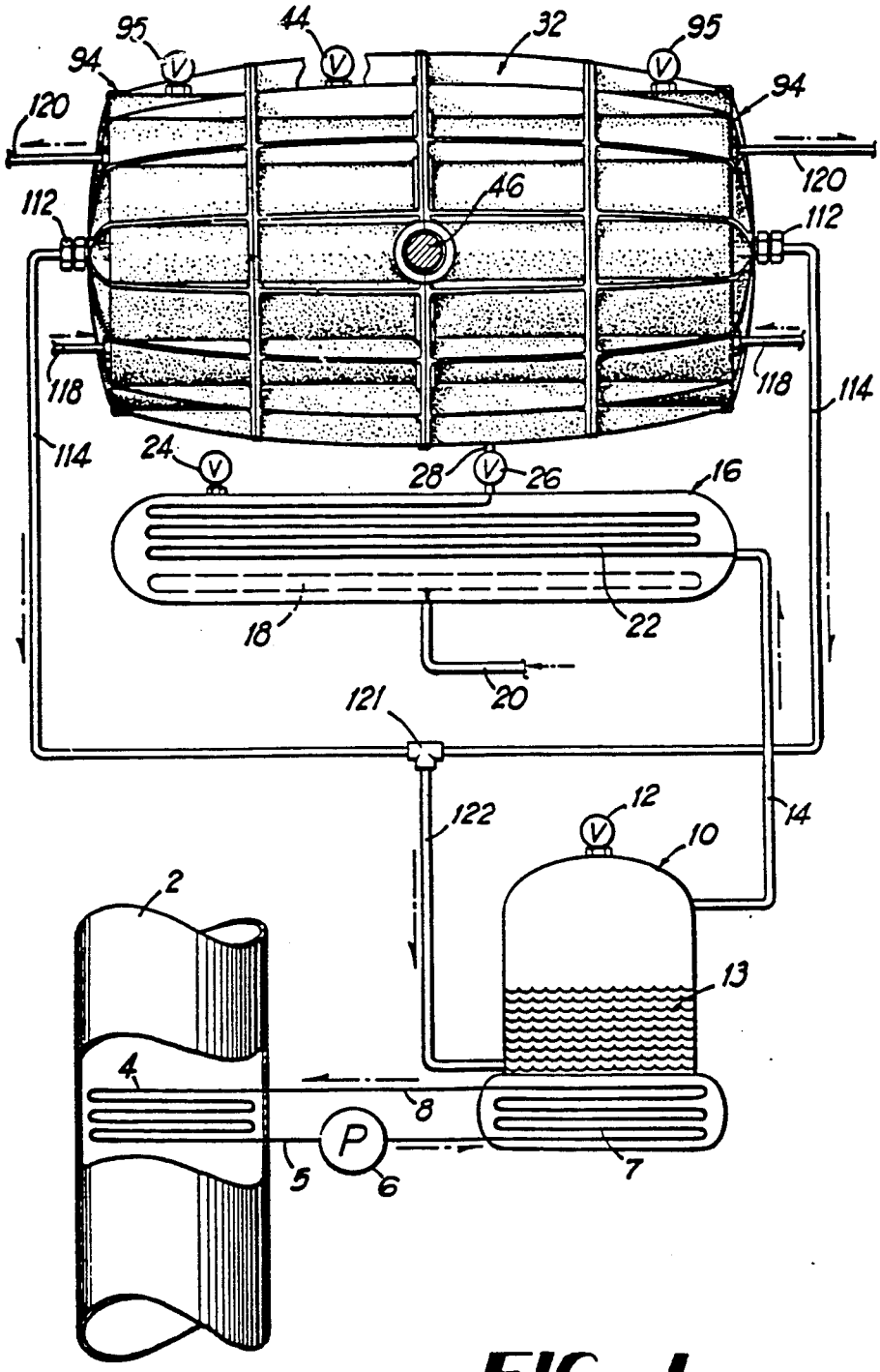
FIG. 1 is a diagrammatic representation of a detailed embodiment of a superheated vapor power actuated generating system utilizing the method disclosed herein and including an exhaust heat source.

Referring to FIG. 1, in a more detailed embodiment a low grade heat source such as an exhaust stack 2 has placed within it a heat absorption coil 4. A fluid such as water flows through coil 4 and absorbs a portion of the heat from the heat source. The fluid is then pumped through line 5 by pump 6 into the heat exchange coils 7 of a saturated vapor generating cell 10 equipped with a pressure relief valve 12 and containing a quantity of liquefied working fluid 13 such as Freon. The working fluid, such as Freon, is heated sufficiently by regulating flow rates through pump 6 to cause the liquefied working fluid to undergo a phase change to saturated vapr. The heat transfer fluid having given up its heat is recycled to heat source 2 through conduit 8.

The working fluid flows as a saturated vapor through conduit 14 into the superheated vapor generating cell 16, which is equipped with a pressure relief valve 24. The superheated vapor generating cell 16 introduces additional heat supplied and controlled by conventional means such as burners 18, fueled by a fuel source from line 20, and regulated by conventional pressure and temperature controls.

The working fluid passes through heating coils 22 picking up sufficient additional heat to become a superheated vapor and then passes through throttling valve 26 and conduit 28 into high pressure fitting 30 in the outer shell 32 of the superheated vapor actuated power generating device 32. The superheated vapor actuated power generating device 32 is equipped with a pressure relief valve 44 and rotational power output shaft 46.

Exiting from both ends of the low pressure vessel 94 of the superheated vapor actuated power generating device 32 are cooling fluid inlet lines 118 and discharge lines 120. Liquefied working fluid is discharged through pressure fittings 112, discharge lines 114, tee fitting 121 and then through conduit 122 into the liquid reservoir of the saturated vapor generating cell 10, completing the closed loop of the working fluid.

Figure 2A:
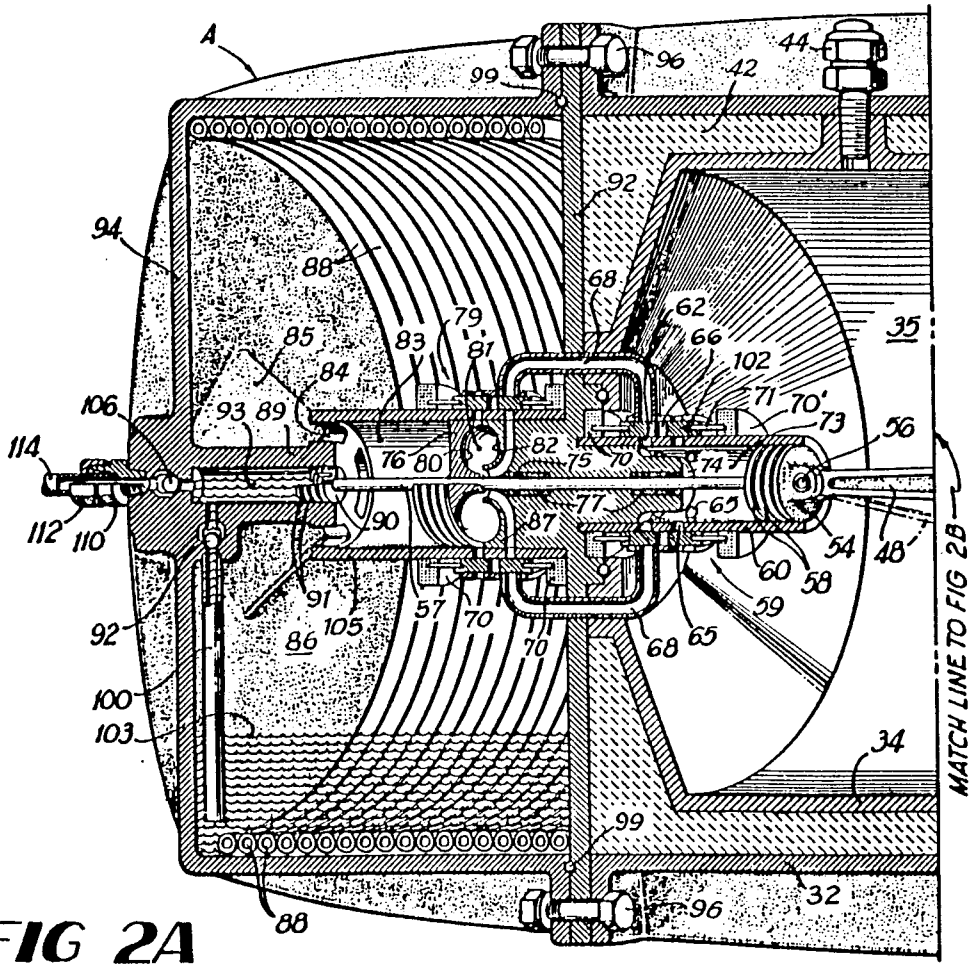
FIGS. 2A and 2B are a longitudinal cross-sectioned perspective view of a portion of the superheated vapor actuated generating system shown in FIG. 1.
Figure 2B:
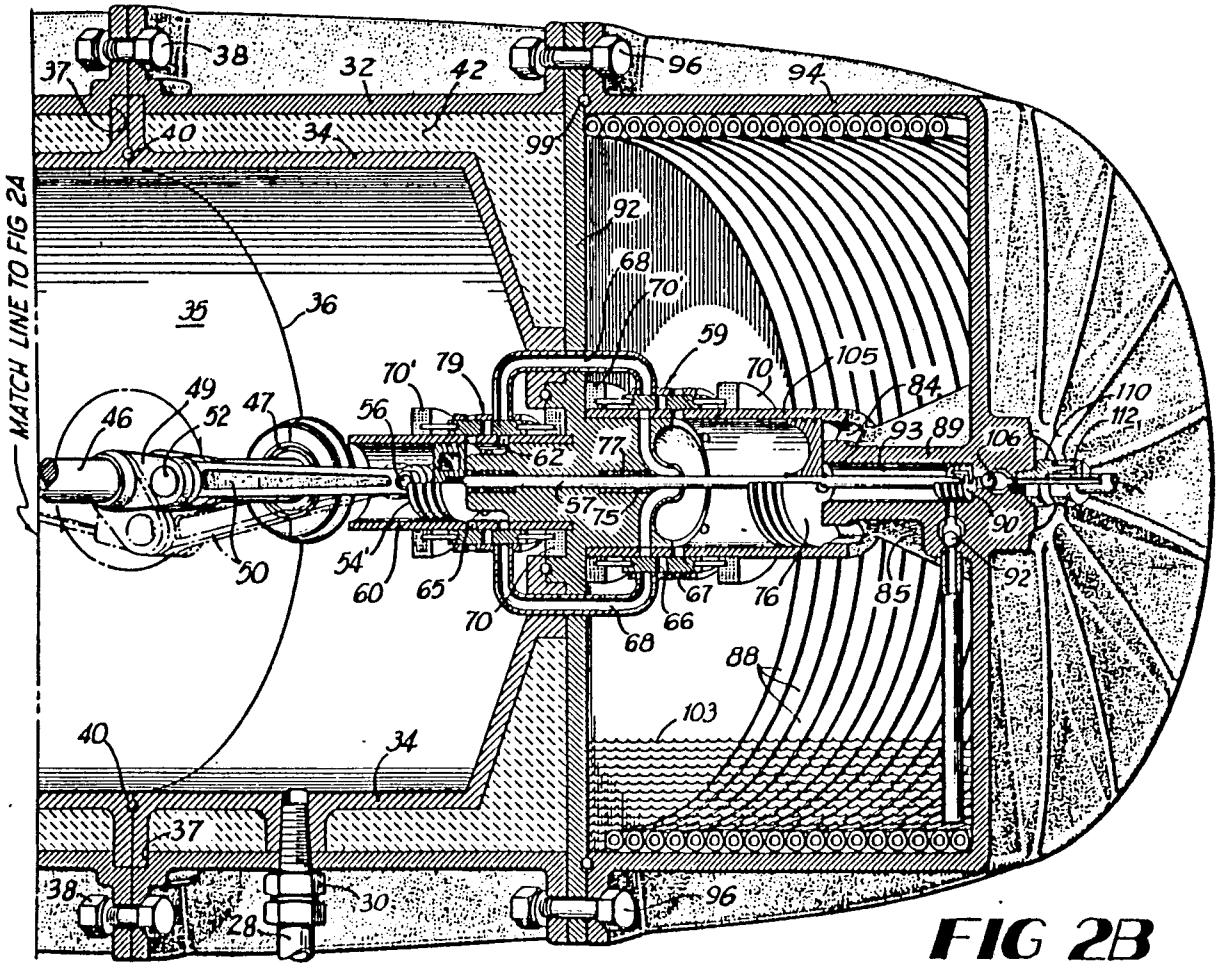

FIG. 2 illustrates a detailed embodiment of the superheated vapor actuated power generating device which comprises an inner cylindrical high pressure vessel formed by left and right walls 34 joined as indicated at 36 and sealed at 40 by seating in a notch 37. The notch 37 is formed at the mating surfaces of the right and left sections of the outer shell 32 and mechanically compressed by a plurality of mechanical connections 38 around the exterior of the outer shell. The volume between the outer shell walls 32 and the high pressure vessel walls 34 is filled with a conventional structural and insulating material such as urethane. The nature of the insulation material such as urethane. The nature of the insulation is preferably such as to effectively bar any significant heat transfer through the insulation thus effectively thermally isolating low pressure vessel volume 86 and high pressure volume 35.

Rotational output shaft 46 is journalled at bearing 47 and connected to the yoke assembly 49 at the end of piston rod 48. Piston rod 50 is connected at the yoke assembly 49 by means of pin 52. High pressure piston 54 of bank A is connected to piston rod 48 and high pressure piston 54' of bank B is connected to piston rod 50 by means of pins 56. Except for the differences in the yoke connection ends of piston rods 48 and 50, the left bank A of the superheated vapor actuated power generating device and right bank B are mirror images of the other so the description of components apply to either bank.

High pressure piston 54 is surrounded by rings 58 within cylinder sleeve 60. The volume 73 contiguous to the top face of high pressure piston 54 is either an isolated volume when communicating port 66 of electromagnetic valve 59 is in its central or closed position, in direct communication with the high pressure volume 34 by the radial alignment of communicating port 66 with the high pressure cylinder sleeve intake ports 65 and valve body ports 67, or in communication with high pressure cylinder discharge conduit 68 by the radial alignment of communicating port 66 with the high pressure cylinder discharge ports 62 and high pressure cylinder discharge conduits 68. By virtue of the movement of high pressure piston 54 and communicating port 66 of electromagnetic valve 59, volume 73 contiguous to the top face of high pressure piston 54 may also be thought of as forming a first variable volume.

Figure 4:
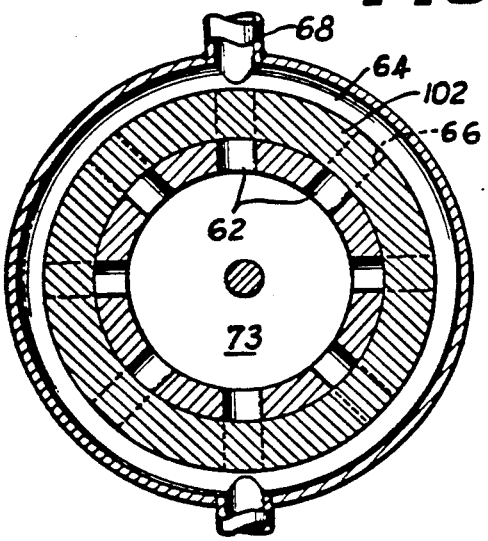
FIG. 4 is a transverse cross-sectional view of the valve assembly taken on line 4—4 of FIG. 3.
Figure 5:
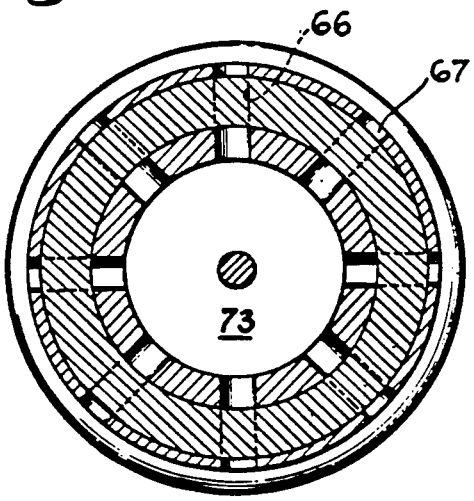
FIG. 5 is a transverse cross-sectional view of the valve assembly taken on line 5—5 of FIG. 3.

By referring to FIG. 4 it can be seen that high pressure cylinder discharge conduits 68 are fed by high pressure cylinder discharge manifold 64 which is in direct communication with the high pressure cylinder volume 73 by a plurality of radial ports 62 when aligned with communicating ports 66. Referring back to FIG. 2, in order to minimize the volume 73 contiguous to the high pressure piston 54 when at top dead center of travel and allow communication with high pressure cylinder discharge conduits 68, the end wall of the high pressure cylinder is formed by the elongated cylindrical structure 74. Connecting rods 57 are attached to the top face of high pressure piston 54 and to the low pressure piston 76 with seals 75 and guides 77 surrounding the connecting rods 57.

Exhaust gases from high pressure cylinder volume 73 are evacuated into a second variable volume such as the varying low pressure cylinder volume 81 contiguous to the bottom face of low pressure piston 76 determined by travel of low pressure piston 76. The concave configuration 80 on the bottom face of low pressure piston 76 and the complimentary concave configuration 82 at the end wall of low pressure cylinders 87 cause the exhaust gases to swirl within the varying low pressure cylinder volume 81. The volume 81 contiguous to at the bottom face of low pressure piston 76 being increased at a greater rate than the decreasing volume 73 contiguous to the top face of high pressure piston 54 plus the volume of conduits 68 causes a lower pressure resulting in a rapid expansion of working fluid into low pressure cylinder volume 81. This in turn results in near total evacuation of working fluid from high pressure cylinder volume 73 and the impartation of work on the bottom face of low pressure piston 76 in the form of expansion of the vapor and kinetic energy of the working fluid molecules while the top face of low pressure piston 76 is exposed to the lowest system pressure that occurs within the working fluid system in low pressure vessel volume or condenser 86. Porting into the low pressure cylinder volumes 81 is performed by electromagnetic valves 79 mechanically similar to electromagnetic valves 59.

The volume 73 contiguous to the top face of low pressure piston 83 is directly communicated with low pressure vessel volume or condenser 86 through a plurality of ports 84 in structure 85 which provides structural support for low pressure cylinder sleeve 105 and cylinder sleeve 89 of injector piston 90 with a plurality of piston rings 91. Low pressure vessel wall 94 is equipped with pressure relief valve 95. Low pressure vessel wall 94 is mechanically attached by conventional means 96 and conventional sealing means 99 at a plurality of flanges to end wall 92 and high pressure vessel outer shell 32. Since as injector piston 90 is directly connected by axial connecting rod 57, as low pressure piston 76 and high pressure piston 54 travel from top dead center to bottom dead center the vacuum caused by the increasing volume 93 causes check valve 92 to unseat and draw liquefied working fluid 103 through suction tube 100 and into ejector volume 93. When injector piston 90 travels from bottom dead center to top dead center, the increased pressure causes check valve 92 to seat and check valve 106 to unseat. This in turn forces liquefied working fluid through pressure fitting 110 and so through the end wall of low pressure vessel 94. This flow is secured by pressure fitting 112 and continues through working fluid discharge line 114.

Working fluid exhausted into low pressure vessel volume or condenser 86 is cooled and liquefied by heat absorption through condenser tubes 88 by running a sufficient quantity of cooling fluid such as water through condenser tubes 88. Liquefaction of the working fluid decreases pressure to the lowest point in the closed working fluid loop allowing the greatest pressure differential to occur between the bottom face of high pressure piston 54 and the directly linked top face of low pressure piston 76 resulting in working forces applied parallel to the axis of piston movement.

Figure 3:
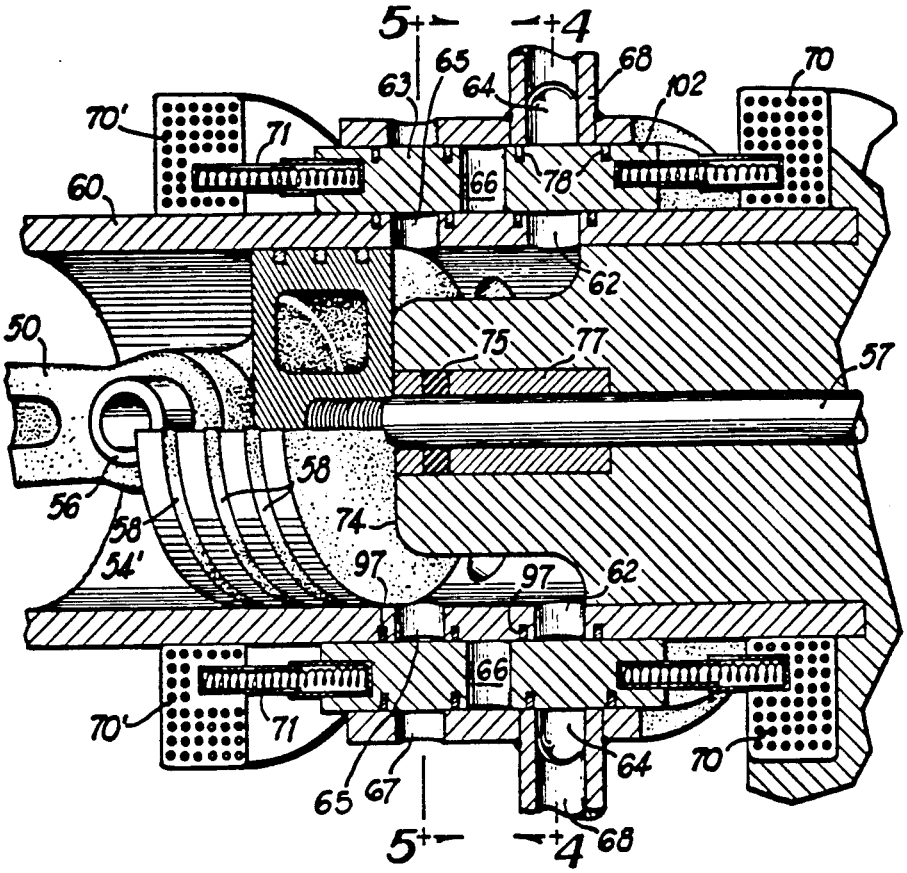
FIG. 3 is a longitudinal cross-sectional view of a valve assembly.

FIG. 3 shows a double action electromagnetic valve assembly 59 which is mechanically similar to electromagnetic valve assembly 79 and consisting of coils 70 and 70', encapsulated spring return assemblies 71, and slide valve bumpers 72. In the non-actuated position spring return assemblies 71 position communicating ports 66 in their neutral or closed position. By activating coil 70 the slide body 102 moves to the right as illustrated in FIG. 3 which radially aligns communicating port 66 with cylinder discharge ports 62 and exhaust manifold 64 which in turn is connected to exhaust conduit 68 when the valve assembly is used in conjunction with high pressure cylinder 54 or to low pressure vessel volume or condenser 86 when used in conjunction with low pressure cylinder 105. Deactivation of coil 70 causes the slide body 102 to return to its closed position by forces exerted by spring return assemblies 71. During activation of coil 70' the slide body 102 moves to the left as illustrated in FIG. 3 and radially aligns communicating ports 66 with cylinder intake ports 65 and valve body intake ports 67. Communicating ports 66 communicate with low pressure vessel volume 86 when used in conjunction with low pressure cylinder 105 or with high pressure discharge conduit 68 when used in conjunction with low pressure cylinder 105.

In more general terms, the superheated vapor power generating device shown in FIGS. 1–3 may consist of a high pressure vessel and one or more low pressure vessels each of which contain one or more reciprocating piston and cylinder assemblies which extract energy associated with a superheated vapor of a working fluid at a constant pressure by a supply of superheated vapor from a generating cell of conventional means into the high pressure vessel the flow of which is regulated by means of a conventional pressure and temperature sensitive throttling valve. The high pressure vessel contains one or more high pressure cylinder and piston assemblies and a rotational output shaft with connection means from the high pressure pistons. The bottom face of each high pressure cylinder is directly exposed to the constant high pressure of the superheated vapor within the high pressure vessel volume. The aggregate internal volume of the high pressure cylinders within the high pressure vessel is greatly exceeded by the total volume of the high pressure vessel which allows the high pressure to be maintained within the high pressure volume.

Slide valves on the outside periphery of the high pressure cylinders permit the volume contiguous to the top face of the high pressure pistons to selectively be in direct communication with the high pressure volume, be isolated, or be discharged to a lower pressure piston which is axially connected to the high pressure piston by a common connecting rod causing it to move in synchronization with the high pressure piston. When the volume contiguous to the top face of the high pressure piston is in communication with the high pressure volume, the pressure on each face of the high pressure piston is equalized resulting in intake of the high pressure superheated vapor with a minimum of negative work being performed. Adiabatic isentropic expansion of the superheated vapor is accomplished by isolating the volume contiguous to the high pressure piston at for example 180 degrees of rotation from top dead center of the high pressure piston's travel by activating the slide valve to a closed position. The arrangement of the present invention allows the adiabatic isentropic expansion of the superheated vapor to occur in the isolated cylinder volume contiguous to the top piston face in such a manner as to not overload the adiabatic isentropic expansion process with more heat energy than it can efficiently utilize. When the slide valve is activated at say 180 degrees of rotation from top dead center so as to allow discharge of the expanded vapor to a larger and lower pressure volume contiguous to the top face of the larger diameter low pressure piston, isobaric forces exerted on the bottom side of the high pressure piston by the constant high pressure of the superheated vapor maintained in the high pressure vessel causes movement of the piston toward top dead center or 360 degrees of rotation.

The high pressure piston, low pressure piston and injector piston are rigidly connected by a common connecting rod. As a result of the low pressure piston and cylinder assemblies being located within one of the low pressure vessel volumes which also serves as a system condenser, the top face of the low pressure pistons are subjected to the lowest pressure of the power generating device's closed system. Due to the direct connection of the high and low pressure pistons, the pressure differential from the bottom face of the high pressure piston to the top face of the low pressure is maximized allowing maximum forces to be exerted on the work producing pistons and thereby maximizing efficiency or the use of available forces and avoiding unnecessary energy waste needlessly introduced in prior devices and processes.

The volume contiguous to the bottom face of the low pressure piston can be selectively isolated, in direct communication with the discharge of the top volume contiguous to the face of the high pressure piston, or exhausted directly to the low pressure vessel volume or condenser with the use of a similar slide valve as used on the high pressure pistons. When the slide valve is actuated so as to receive the discharge from the volume contiguous to the high pressure cylinder, a larger cylinder volume is swept by the larger diameter low pressure piston which creates a lower pressure and results in nearly a complete evacuation of the vapor from the volume contiguous to the top face of the high pressure piston. The flow of the vapor from the volume contiguous to the top face of the high pressure piston expands rapidly within the volume contiguous to the bottom face of the low pressure cylinder as a result of a unique swirl chamber consisting of concave formations of the low pressure piston's bottom face and the low pressure cylinder's end wall thereby also efficiently utilizing the kinetic forces of the vapor flow. When the slide valve is actuated so as to isolate the volume contiguous to the bottom face of the low pressure piston face, further expansion of the working fluid vapor is accomplished through the travel of the piston to top dead center. After this expansion, the slide valve is actuated so as to allow the expanded vapor contiguous to the bottom face of the low pressure cylinder to be exhausted directly to the low pressure vessel or condenser volume and liquefaction of the expanded working vapor is affected by the removal of heat by the condenser. When exhausting to the low pressure vessel or condenser volume, the pressure differential across the low pressure piston is equalized and discharge of the expanded vapor is to the power generating device's lowest pressure which again minimizes wasted energy.

The injector pistons are located within each of the low pressure vessels or condenser volumes. The injector pistons are also axially connected to the low pressure piston by the common connecting rod of the high and low pressure pistons. The injector piston draws from the liquefied working fluid reservoir and positively displaces the working fluid to a reservoir with a heat source. With the injector piston and cylinder assembly being located within each of the power generating device's condensers, cavitation and vapor lock experienced in prior devices may be substantially, if not completely avoided, by the heat removal accomplished by the condenser which surrounds the injector piston and cylinder assembly.

If the working fluid is one of the volatile fluids with a low boiling point, low grade heat sources such as waste or cogenerated, solar, or other similar low grade heat sources can be used singularly or in combination to cause the liquefied working fluid to undergo another phase change to a saturated vapor. A second reservoir and heat source could be used to superheat the saturated vapor with conventional means and controls being used to provide such heat as necessary to provide superheated vapor in a sufficient amount and at a desired temperature and pressure to maintain operating temperature and pressures within the high pressure volume of the superheated vapor power generating device at optimum levels as determined by the working fluid used and the quality of available energy.

Figure 16:
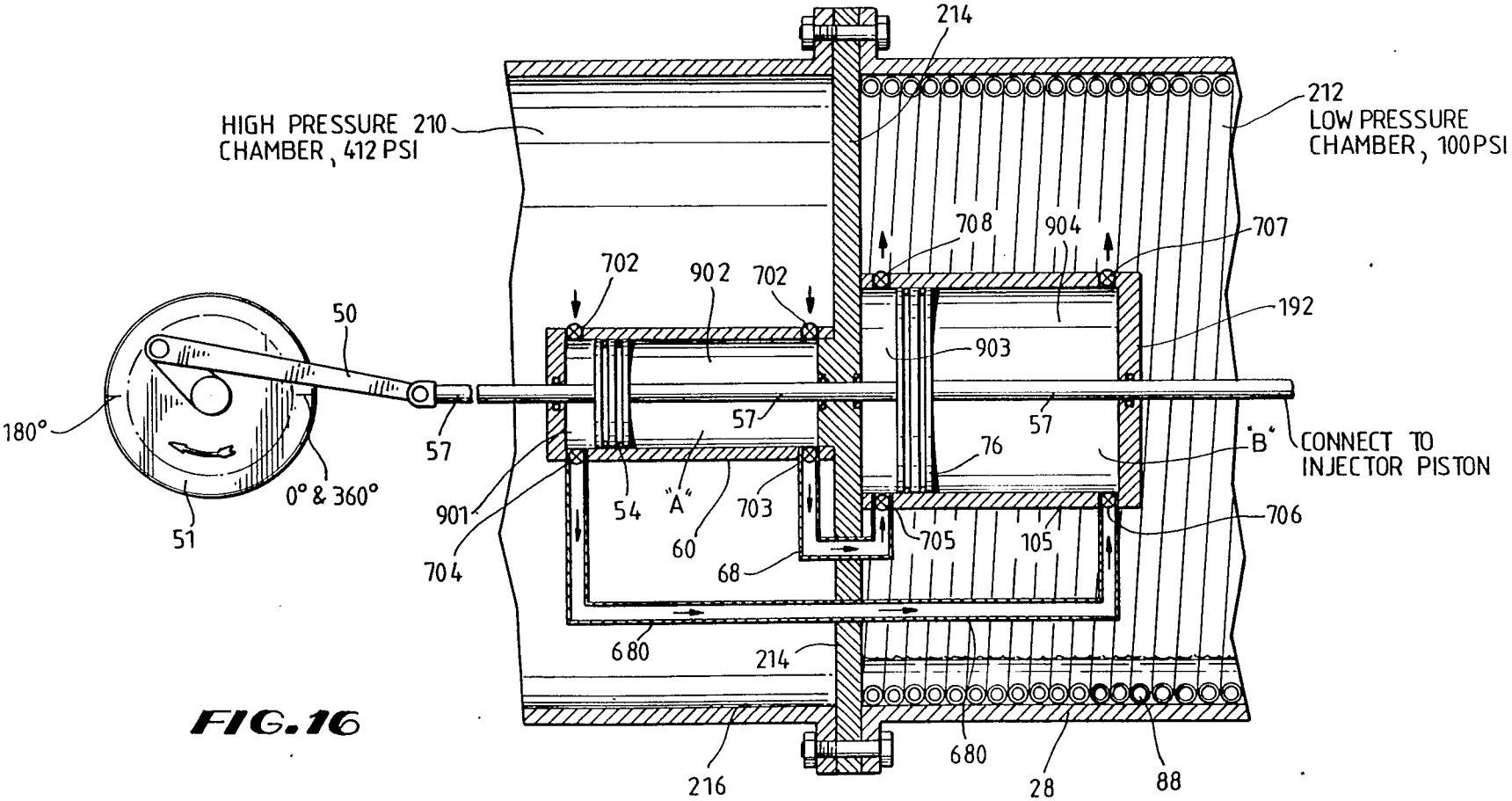
FIG. 16 is a schematic representation of another embodiment of the vapor power generating system wherein work is generated through most of a 360 degree cycle.

FIG. 16 shows the schematic of another embodiment made in conjunction with the present disclosure. This may be thought of as a double action engine or cycle since work is performed not only from 0 degrees to 180 degrees, but also from 181 degrees to 360 degrees.

Referring to FIG. 16, the assembly is much the same as shown in FIGS. 9–11 with the injector piston 90 not being shown. However, high pressure cylinder 60 is enclosed by wall 190 rather than being exposed to the high pressure reservoir 210. Similarly, low pressure cylinder 105 is enclosed by wall 192 rather than being exposed to the low pressure reservoir 212. Valves 702 and 707 serve to place the high and low pressure cylinders in selective fluid communication with the high and low pressure reservoirs, respectively. Additionally, unlike the configuration shown in FIGS. 9–11, a second discharge conduit 680 is provided. Valve 704 is located at the juncture of the second discharge conduit 680 and high pressure cylinder 60 at a point below high pressure piston 54. Valve 706 is located at the juncture of the second discharge conduit 680 and low pressure cylinder 105 at a point above the low pressure piston 76. Thus, the second discharge conduit 680 along with valves 704 and 706 place a portion of the high pressure cylinder in selective fluid communication with an upper portion of the low pressure cylinder. It is to be noted that valves 701, 702, 705 and 706 essentially perform as intake valves, while valves 703, 704, 707, 708 essentially perform as discharge valves in relation to the cylinders.

The cylinder and piston assemblies may be thought of as forming four variable volumes 901–904. The first variable volume 901 is defined by the lower face of high pressure cylinder 54 and high pressure cylinder walls 60, while the second variable volume 902 is formed by the upper face of high pressure cylinder 54 and high pressure cylinder walls 60. The third variable volume 903 is defined by the lower face of low pressure piston 76 and the walls of low pressure cylinder 105, while the fourth variable volume 904 is formed by the upper face of low pressure piston 76 and the walls of low pressure cylinder 105.

In operation valves 702, 703, 705, 707 are open and valves 701, 704, 706 and 708 are closed as the pistons move from about 1 degree to 180 degrees, while valves 702, 703, 705, 707 are closed and valves 701, 704, 706 and 708 are open as the pistons move from about 181 degrees to 360 degrees in relation to the working shaft. As a result, work is obtained from the engine through most of the 360 degrees cycle of the pistons with the work in the high pressure cylinder being generally isobaric and the work in the low pressure cylinder being generally isentropic. Thus, work is first imparted to the working shaft 46 by placing the first variable volume 901 in fluid communication with the high pressure zone 210 by means of valve 702 while allowing discharge of working fluid from the second variable volume 902 to the third variable volume 903 by discharge conduit 68 with valves 703 and 705 open. Concurrently therewith, the fourth variable volume 904 is in fluid communication with the low pressure reservoir 212 by means of valve 707, which is open.

After rotation through 180 degrees further work is imparted to the working shaft 46 by changing the sequence of the valves and placing the second variable volume 902 in fluid communication with the high pressure zone via valve 701 while allowing discharge of working fluid from the first variable volume 901 to the fourth variable volume 904 by means of the second discharge conduit 680 with valves 704 and 706 being open. Concurrently therewith, the third variable volume 903 is put in fluid communication with the low pressure reservoir 212 by means of valve 708.

As would be known to one skilled in the art having the benefit of this disclosure, this last described embodiment not only provides work through most of the 360 degrees cycle of rotation, but also provides many of the advantages provided by other embodiments disclosed herein. Additionally, many of the same materials and operating variables would apply.

As will be appreciated by one skilled in the art having the benefit of this disclosure a number of modifications may be made to the foregoing apparatus and method within the spirit of the present invention. For example, the connecting rod 50 shown in FIG. 9 may be coupled directly to a reciprocating rod rather than a rotatable shaft.

There now follows by way of further illustration a computer generated example.

EXAMPLE

A computerized engine simulation model was prepared on the system generally shown in FIGS. 1A–3. (Reference to numbers is to FIG. 9).

Part one of the computer program calculated the thermodynamic cycle parameters based on given operating temperatures defining the high and low sides of the cycle. The main output parameters were minimum flow rates, ideal work output, head input and output requirements for sustained engine operation, and Carnot efficiency.

Part two of the program calculated the piston displacements and thermodynamic properties of the vapor inside the two cylinders in major increments of two degrees of rotation of the crankshaft. During the power stroke each such angular increment was further subdivided into minor increments of 25 steps to minimize approximation errors and ensure smooth modelling and convergence in all iterations. This was most important during the first 2 degrees after opening the valve connecting cylinders A and B (i.e. the high and low pressure cylinders, respectively) because of the large pressure difference between the volumes. It was also important when the volume rate of change was large.

Several assumptions were made, including that:

1. no losses occurred when gas from the high pressure chamber entered into cylinder A (the high pressure cylinder) through the inlet valve;
2. no losses occurred when gas from cylinder B (the low pressure cylinder) entered the low pressure chamber through the exhaust valve;
3. the conditions in both the high and low pressure chambers remained constant throughout the engine cycle;
4. no heat transfers occurred from the high pressure chamber into the low pressure chamber; and
5. no heat transfers occurred through the cylinder walls during the engine cycles.

The cylinder arrangement took into account clearance and transfer line volumes. Flow losses in the valve were accounted for in a discharge coefficient (cd) which was input to the program. A value of 0.9 was used in this study, assuming a well contoured channel design.

The initial operating conditions were determined based upon three known temperatures input to the program: (1) the system high temperature, THIGH, which is the temperature of the available heat source; (2) the system low temperature, TLOW, which is the temperature of the available cooling medium; and (3) the degrees of superheat, TSUP, selected at the low condenser pressure to ensure a dry vapor state in cylinder B at the end of the power stroke. The low side pressure, PLOW, was calculated knowing the condenser temperature, TLOW. Next the entropy and all other state variables were calculated at the PLOW pressure and TLOW+TSUP temperature. The high pressure, PHIGH, was then calculated through iteration knowing the temperature THIGH and the entropy (assumed equal to the low side entropy). Saturated conditions were calculated for both the liquid and vapor phase at the high and low pressures. This enabled calculation of cycle thermal efficiency for both a Carnot engine and the present embodiment.

Figure 6:
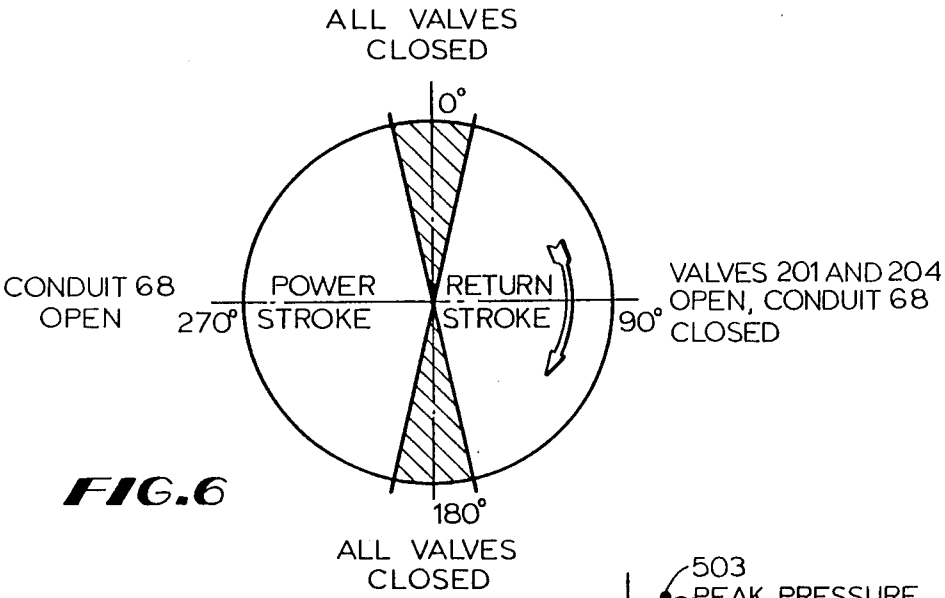
FIG. 6 is a diagram of valve timing.

To maximize the net power output of the cycle, the valve timing was felt to be important. Adequate timing was needed not only to ensure that the vapor entered and left the cylinders, but also to prevent "bleeding" or leaking through the engine without performing any useful work. The valve timing is graphically shown in FIG. 6.

The work cycle consisted of four parts, two of which were identical. These were: a return stroke (filling A and exhausting B); a compression/expansion stroke (all valves closed); and a power stroke (only conduit 68 open).

During the return stroke the conditions reverted back to the initial conditions in the high and low pressure chambers.

For every rotational position of the crankshaft the following parameters were calculated: piston position; piston velocity; cylinder volume; vapor state variables; mass in cylinder; mass leaving or entering the cylinder; net pressure acting upon the piston; engine torque; and work in each cylinder. The flow through conduit 68 was also modelled. FIG. 7 shows the two flow regions, choked and unchoked flow, which do occur in the valve openings and which affect the flow losses. If the actual mass flow rate, expressed in pounds per second (lbm/sec) is multiplied by the square root of the absolute temperature (degrees Rankine) and divided by the product of the pressure and flow area, a parameter called "corrected mass flow" is obtained. This corrected mass flow is primarily a function of pressure ratio and to a lesser degree specific heat ratio (which in turn is a function of both pressure and temperature). There exists a critical pressure ratio (low pressure/high pressure) at which maximum corrected mass flow is obtained. For pressure ratios below critical the corrected mass flow remains constant (i.e. choked flow), while for pressure ratios above critical the mass flow decreases (i.e. unchoked flow) with increased pressure ratio.

The thermodynamic parameters calculated in each step were the five state variables: pressure (P), temperature (T), specific volume (vsp), enthalpy (h), entropy (s), and the specific heats at constant pressure (cp) and constant volume (cv). These parameters were all expressed in virial equations as functions of pressure and temperature. If any two of the given state variables are known, the remaining three can be calculated. In the most frequently occurring situation one of the known variable was the specific volume due to known mass and piston position, and the second known variable depended on the process.

TABLE 1

ENGINE ANALYSIS. R-22 WORKING FLUID

| | | | |
|---|---|---|---|
| Piston stroke = | 4.500 [in] | | |
| Connecting rod = | 6.000 [in] | | |
| Engine speed = | 450.000 [RPM] | | |
| Angular velocity = | 2.7 [deg/milli-sec] | | |
| Crank angle increment = | 2. [deg] | | |
| Time per degree rotation = | .370 [milli-sec] | | |
| Time per 2 degree rotation = | .741 [milli-sec] | | |
| Inlet Valve | | Rejection Valve | |
| Opens at | 1. deg | Opens at | 181. deg |
| Closes at | 179. deg | Closes at | 359. deg |
| Flow area | 1.0 [sq.in] | Flow area | 3.0 [sq. in] |
| Disch. coeff. | .9 | Disch. coeff. | .9 |
| P-high = | 411.37 [psia] | P-low = | 98.73 [psia] |
| T-high = | 200.00 [F] | T-low = | 55.00 [F] |
| Enthalpies: | | | |
| low press, satur. = | 24.3 [BTU/lbm] | | |
| hi-press, sup. ht. = | 125.5 [BTU/lbm] | | |
| lo-press, sup. ht. = | 109.9 [BTU/lbm] | | |
| Expansion delta-H = | 15.6 [BTU/lbm] | | |
| Entropy: At initial high pr. = | .21981 [BTU/lbm/R] | | |

Vapor Conditions at Closing of

TABLE 1-continued

| ENGINE ANALYSIS. R-22 WORKING FLUID | | | |
|---|---|---|---|
| | | Inlet Valve | Rejection Valve |
| Crank Angle | [degrees] | 179. | 359. |
| Cylinder Volume A | [cu. in] | 31.17 | 9.97 |
| Cylinder Volume A | [cu. ft] | .01804 | .00577 |
| Specific Volume | [cu. ft/lbm] | .15020 | .56463 |
| Vapor Mass | [lbm] | .12012 | .01022 |

| | | |
|---|---|---|
| Mass flow = | .110 [lbm/rev] | |
| Mass flow = | 49.45 [lbm/min] | |
| Mass flow = | 2967. [lbm/hr ] | |
| Volume flow = | .634 [cu/ft/min ] | (Liquid phase) |
| Volume flow = | 4.7 [gallon/min] | (Liquid phase) |
| Heat supply reqmnt = | 300214. [BTU/hour] | |
| Heat supply reqmnt = | 88.0 [KW] | |
| Heat of expansion = | 46339. [BTU/hour] | |
| Heat of expansion = | 13.6 [KW] | |
| Heat supplied in evaporator = | 101.2 [BTU/lbm] | |
| Heat rejected in condenser = | 85.6 [BTU/lbm] | |
| Ideal cycle thermal efficiency = | 15.4 [percent] | |

TABLE 2

| GEOMETRIC DATA FOR PISTON/CYLINDERS A AND B | | |
|---|---|---|
| | Cylinder A | Cylinder B |
| Piston Diameter | 2.500 [inch] | 5.500 [inch] |
| Torus Diameter | 1.750 [inch] | 4.500 [inch] |
| Torus Depth | 1.750 [inch] | .125 [inch] |
| End Clearance | .125 [inch] | .125 [inch] |
| Con.Rod Diameter | .500 [inch] | |
| Piston Area | 4.712 [sqin] | 23.562 [sqin] |
| Con. Rod Area | .196 [sqin] | |
| A/B Line Volume | 5.000 [cuin] | .000 [cuin] |
| Torus Volume | 4.381 [cuin] | .982 [cuin] |
| Clearance Volume | .589 [cuin] | 2.945 [cuin] |
| Minimum Volume | 9.970 [cuin] | 3.927 [cuin] |
| Maximum Volume | 31.176 [cuin] | 109.956 [cuin] |
| Displacement (max) | 21.206 [cuin] | 106.029 [cuin] |
| Displacement (act) | 21.203 [cuin] | 106.013 [cuin] |

TABLE 3

| CARNOT CYCLE ENTHALPIES | | | |
|---|---|---|---|
| Pump, low side = | 53.5 [BTU/lbm] | Vapor quality = | 34.5 [%] |
| Expansion, low side = | 99.5 [BTU/lbm] | Vapor quality = | 88.8 |
| Heat supplied in evaporation = | | 55.3 [BTU/lbm] | |
| Heat rejected in condensation = | | 46.0 [BTU/lbm] | |
| Expansion work output = | | 13.1 [BTU/lbm] | |
| Pump work required = | | 3.8 [BTU/lbm] | |
| Cycle thermal efficiency = | | 16.8 [percent] | |
| Condenser temperature = | | 50.0 [F] | |
| Evaporator temperature = | | 153.2 [F] | |
| Ideal cycle thermal efficiency relative to maximum Carnot cycle thermal efficiency: 91.6% | | | |

TABLE 4

| ENGINE PERFORMANCE SUMMARY | | | |
|---|---|---|---|
| | Cyl. A | Cyl. B | Total |
| Engine power [ft-lbf/sec] | 2929. | 6026. | 8956. |
| Engine Power [ft-lbf/min] | 175741. | 361589. | 537330. |
| Engine Power [BTU/hour] | 13556. | 27891. | 41446. |
| Engine Power [KW] | 4.0 | 8.2 | 12.1 |
| Engine Power [HP] | 5.3 | 11.0 | 16.3 |
| Mean effective pressure [psia] | 221.03 | 90.95 | 112.63 |
| Mean effective pressure as % of Max. pressure diff | 70.7 | 29.1 | 36.0 |

Various data and results are shown in Tables 1–4. As to net engine power output the two-cylinder engine with a total displacement volume of 127.2 cubic inches operating between 55 and 200 degrees Fahrenheit produced a calculated net output of 12.1 kilowatts. The net output for a two bank engine would be about twice the value of the analyzed single bank engine, or 24.2 kilowatts.

Coefficient of performance may be defined as the ratio of engine output power to heat of expansion. For this engine the power is 12.1 kilowatts and the theoretical heat of expansion is equivalent to 13.6 kilowatts. In other words, the calculated coefficient of performance equals 89.0 percent.

Energy efficiency ratio may be defined as the ratio of the thermal efficiency of the modified Rankine and the Carnot cycles. The thermal efficiency of any cycle is the ratio of work delivered to the heat added. It has been postulated that the Carnot cycle employing a perfect gas depends on temperatures alone and provides maximum thermal efficiency. The goal would then be to approach the Carnot operating lines as close as possible for best thermal effiiency. The engine thermal efficiency ratio was calculated as 91.6 percent (see Tables 2 and 4).

Based upon a previous study the system thermal efficiencies range from a low of 6.2 percent to a high of 17.2 percent depending on the high (hot) and the low (cold) side temperatures of the system. Freon 22 was arbitrarily chosen as a working fluid based upon the temperature range which covered a range of temperatures from 35 to 200 degrees Fahrenheit. The system thermal efficiency was calculated as 15.4 percent.

For the data generated in Tables 1–4, the calculated mean effective pressures were: 221.0 psia for cylinder A, 91.0 psia for cylinder B, and 112.6 psia for A and B. The combined mean effective pressure was calculated as the total work in A and B divided by the total swept volumes in A and B (the actual displacements). FIG. 8 shows pressure differentials versus crank angle for cylinders A and B.

The mechanical efficiency is a strong function of piston speed which for the subject engine was set at a maximum 265 fet per minute. This is about one third of the speed of a typical internal combustion engine. Using low friction materials should further enhance the mechanical efficiency. This may translate into a friction loss of less than 5 psi in mean effective pressure.

Further modifications and alternate embodiments of the apparatus and method disclosed herein will be apparent to those skilled in the art having the benefit of this description. Accordingly, this description is to be construed as illustrative only and is for the purpose of teaching those skilled in the art the manner of carrying out the invention. It is to be understood that the forms of the invention herewith shown and described will be taken as a presently referred embodiments. Various changes may be made in size, shape and arrangement of parts. For example, equivalent elements or materials may be substituted for those illustrated and described herein, parts may be reversed, and certain features of the invention may be utilized independently of the use of other features, all of which would be apparent to one skilled in the art after having the benefit of this description of the invention and its various embodiments.

What is claimed is:

1. A method of generating power comprising:

heating a working fluid to a superheated vapor;

supplying the superheated vapor to a high pressure zone having a high pressure cylinder and piston operably connected to a working shaft to maintain the high pressure zone at a substantially constant high pressure;

forming an isolated subvolume of working fluid in the high pressure cylinder;

constantly decreasing the subvolume of working fluid in the high pressure cylinder by discharging the subvolume to a low pressure cylinder and piston assembly located in a low pressure zone to constantly increase the subvolume of working fluid in the low pressure cylinder.

2. A process for generating power comprising the steps of:

generating a superheated vapor from a working fluid;

supplying the superheated vapor to a high pressure zone to maintain the high pressure zone at a substantially constant high pressure;

imparting work to a working shaft rotatably coupled to a high pressure piston by constantly exposing the lower face of the high pressure piston to the vapor in the high pressure zone while selectively exposing the upper face of the high pressure piston to the vapor in the high pressure zone as the high pressure piston approaches upper dead center in relation to the working shaft, said upper face of the high pressure piston forming a first variable volume with the high pressure cylinder wall; and concurrently therewith intermittently discharging vapor from the first variable volume to a larger second variable volume formed of the lower face of a low pressure piston linked directly to the high pressure piston and a low pressure cylinder wall while constantly exposing the upper face of the low pressure piston to low pressure vapor in a low pressure zone and intermittently exposing the second variable volume to the low pressure zone, said second variable volume being allowed to increase more rapidly than the first variable volume decreases as the high and low pressure pistons move from bottom dead center to top dead center in relation to the working shaft.

3. A process according to claim 2 wherein high pressure vapor in the first variable volume generally undergoes an adiabatic isentropic expansion as the vapor is intermittently discharged from the first variable volume to the second variable volume.

4. A process according to claim 2 wherein vapor in the high pressure zone impacting the lower face of the high pressure piston performs a generally isobaric work process as the vapor is intermittently discharged from the first variable volume to the second variable volume.

5. A process according to claim 2 wherein the working shaft is operably connected to the high pressure piston by a crank mechanism rotating through 360 degrees and wherein the work imparted is imparted as the crank mechanism rotates from approximately 181 degrees to 360 degrees.

6. A process according to claim 5 wherein the high pressure piston attains a minimum pressure differential within at least a few degrees of the end of the power stroke.

7. A process according to claim 6 wherein the high pressure piston attains high mean effective pressure as the crank mechanism recedes within no more than a few degrees from the optimum angle for exerting force on the crank mechanism.

8. A process according to claim 7 wherein the high pressure piston attains highest net torque as the crank mechanism approaches an angle of approximately 300 degrees based on a rotation of 181 degrees through 360 degrees.

9. A process according to claim 5 wherein the low pressure piston attains a maximum pressure differential at the beginning of the power stroke.

10. A process according to claim 9 wherein the low pressure piston attains high mean effective pressure as the crank mechanism approaches within a few degrees of the optimum angle for exerting force on the crank mechanism.

11. A process according to claim 10 wherein the low pressure piston attains its highest net torque as the crank mechanism approaches an angle of approximately 240 degrees based on a rotation of 181 degrees to 360 degrees.

12. A process according to claim 11 wherein the high pressure piston and the low pressure piston attain their highest net combined torque as the crank mechanism approaches an angle of approximately 260 degrees based on a rotation of 181 degrees to 360 degrees.

13. A process according to claim 2 wherein the lower face of the high pressure piston is substantially constantly exposed to a maximum high pressure and the upper face of the low pressure piston is substantially constantly exposed to a minimum low pressure whereby the maximum pressure differential may be maintained across the high pressure and low pressure pistons as they impart work to the working shaft.

14. A process according to claim 2 wherein the low pressure cylinder diameter is at least twice the diameter of the high pressure cylinder diameter.

15. A process according to claim 14 wherein the low pressure cylinder diameter is at least three times the diameter of the high pressure cylinder diameter.

16. A process according to claim 2 wherein the vapor in the low pressure zone is condensed.

17. A process according to claim 16 wherein the step of generating a superheated vapor comprises heating the condensed vapor from the low pressure zone using a low grade heat source sufficiently to cause the condensed vapor to undergo a phase change to saturated vapor and thereafter by additionally heating under constant pressure the saturated vapor while exposing it to another heat source to form the superheated vapor.

18. A process according to claim 2 further comprising the step of thermally insulating the high and low pressure zones.

19. A process according to claim 2 wherein the temperature of the superheated vapor is less than about 400 degrees F.

20. A process according to claim 2 wherein the working fluid is at a maximum pressure of no more than about 700 psig.

21. A process according to claim 20 wherein the working fluid is at a maximum pressure in the range of about 300 to 400 psig.

22. A process according to claim 2 wherein the working shaft is rotatable and rotates at a speed of less than about 450 revolutions per minute.

23. A process according to claim 22 wherein the working shaft rotates at a speed of less than about 120 revolutions per minute.

24. A process according to claim 2 wherein the working fluid comprises a refrigerant capable of undergoing a phase change within the desired thermal operating range.

25. A process according to claim 24 wherein the working fluid is Freon.

26. A process according to claim 24 wherein the working fluid is water.

27. A process according to claim 2 wherein the working shaft is operably connected to the high pressure piston by a crank mechanism rotating through 360 degrees and wherein the high and low pressure pistons attain a combined high mean effective pressure as the crank mechanism approaches within at least a few degrees of the optimum angle for exerting force on the crank mechanism.

28. A process according to claim 2 wherein the working shaft is operably connected to the high pressure piston by a crank mechanism rotating through 360 degrees and wherein the high pressure piston attains high mean effective pressure as the crank mechanism recedes no more than a few degrees from the optimum angle for exerting force on the crank mechanism.

29. A process according to claim 2 wherein the temperature of the vapor drops such that the expansion of vapor is completed in the low pressure zone before the second variable volume has expanded to a maximum by movement of the low pressure piston and further comprising the step of selectively exposing the second variable volume to the low pressure zone to prevent a vacuum from being drawn in the second variable volume.

30. A process according to claim 2 wherein the temperature of vapor increases such that the expansion of vapor is limited in the low pressure zone and further comprising the step of selectively exposing the first and second variable volumes to the high and low pressure zones, respectively, to permit the required expansion of the vapor discharge from the first to the second variable volumes.

31. A process according to claim 2 wherein the mass flow of vapor is reduced during operation by extending of the time that the first variable volume is in fluid communication with the high pressure zone and extending of the time the second variable volume is in fluid communication with the low pressure zone prior to the transfer of mass from the first variable volume to the second variable volume.

32. A process according to claim 2 wherein the efficiency of the process is at least about 90 percent as compared to a Carnot cycle.

33. A process for generating power comprising the steps of:

generating a superheated vapor from a working fluid;

supplying a superheated vapor to a high pressure zone to maintain the high pressure zone at a substantially constant high pressure;

first imparting work to a working shaft coupled to an enclosed high pressure piston by placing a first variable volume comprising the lower face of the high pressure piston and the high pressure cylinder walls in fluid communication with the high pressure zone while allowing discharge of working fluid from a second variable volume formed from the upper face of the high pressure piston and the high pressure cylinder walls to a third variable volume formed by the lower face of an enclosed low pressure piston linked to the high pressure piston and low pressure cylinder walls while concurrently therewith placing a fourth variable volume comprising the upper face of the low pressure piston and the low pressure cylinder walls to a low pressure zone, the low pressure zone being maintained at a substantially constant low pressure; and thereafter imparting further work to the working shaft by placing the second variable volume in fluid communication with the high pressure zone while allowing discharge of working fluid from the first variable volume to the fourth variable volume while concurrently placing the third variable volume in fluid communication with the low pressure zone.

34. A process according to claim 33 wherein high pressure vapor in the second variable volume generally undergoes an adiabatic isentropic expansion as the vapor is intermittently discharged from the second variable volume to the third variable volume, and thereafter undergoes a similar process between the first and fourth variable volumes.

35. A process according to claim 33 wherein vapor in the high pressure zone impacting the lower face of the high pressure piston performs a generally isobaric work process as the vapor is intermittently discharged from the second variable volume to the third variable volume, and thereafter undergoes a similar process wherein vapor in the high pressure zone impacting the upper face of the high pressure piston performs a generally isobaric work process as the vapor is intermittently discharged from the first variable volume to the fourth variable volume.

36. A process according to claim 33 wherein the pressure differential that occurs across the high and low pressure pistons results from a single mass that flows between the second and third variable volumes and alternately between the first and fourth variable volumes.

37. A process according to claim 33 wherein the working shaft is operably connected to the high pressure piston by a crank mechanism rotating through 360 degrees and wherein the work first imparted is imparted as the crank mechanism rotates from approximately 0 to 180 degrees in a first power stroke and wherein the work thereafter imparted is imparted as the crank mechanism rotates from approximately 181 to 360 degrees in a second power stroke.

38. A process according to claim 37 wherein a maximum pressure differential exists across the high pressure piston as it approaches within at least a few degrees of the end of each of the first and second power strokes.

39. A process according to claim 38 wherein the high pressure piston attains high mean effective pressure as the crank mechanism is receding within no more than a few degrees from the optimum angle for exerting force on the crank mechanism as it passes through each of the first and second power strokes.

40. A process according to claim 39 wherein the high pressure piston attains its highest net torque as the crank mechanism approaches an angle of approximately 120 degrees during the first power stroke and 300 degrees during the second power stroke.

41. A process according to claim 37 wherein the low pressure piston attains a maximum pressure differential across the low pressure piston as the low pressure piston is within at least a few degrees of the beginning of each power stroke.

42. A process according to claim 41 wherein the low pressure piston attains high mean effective pressure as the crank mechanism approaches at least within a few degrees of the optimum angle for exerting force on the crank mechanism.

43. A process according to claim 42 wherein the low pressure piston attains the highest net torque as the crank mechanism approaches an angle of approximately 60 degrees during the first power stroke and approximately 240 degrees during the second power stroke.

44. A process according to claim 37 wherein the high and low pressure pistons attain a combined high mean effective pressure as the crank mechanism approaches within at least a few degrees of the optimum angle for exerting force on the crank mechanism.

45. A process according to claim 44 wherein the high pressure piston and the low pressure piston attain the highest net combined torque as the crank mechanism approaches an angle of approximately 80 degrees during the first power stroke and approximately 260 degrees during the second power stroke.

46. A process according to claim 33 wherein the vapor in the low pressure zone is condensed.

47. A process according to claim 33 wherein the lower face of the high pressure piston is substantially constantly exposed to a maximum high pressure in the high pressure zone and the upper face of the low pressure piston is substantially constantly exposed to a minimum low pressure in the low pressure zone whereby the maximum pressure differential may be maintained across the high and low pressure pistons as they impart work to the working shaft.

48. A process according to claim 33 wherein the low pressure cylinder diameter is at least twice the diameter of the high pressure cylinder diameter.

49. A process according to claim 48 wherein the low pressure cylinder diameter is at least five time the diameter of the high pressure cylinder diameter.

50. A process according to claim 33 wherein the step of generating a superheated vapor comprises heating the condensed vapor from the low pressure zone using a low grade heat source sufficiently to cause the condensed vapor to undergo a phase change to saturated vapor during an isobaric heat addition process and thereafter increasing the heat content of the saturated vapor while exposing it to another heat source to form the superheated vapor.

51. A process according to claim 33 further comprising the step of thermally insulating the high and low pressure zones.

52. A process according to claim 33 wherein the temperature of the superheated vapor is no more than approximately 400 degrees F.

53. A process according to claim 33 wherein the working fluid is at a maximum pressure of about 700 psig.

54. A process according to claim 33 wherein the working shaft is rotatable and rotates at a speed of no more than about 450 revolutions per minute.

55. A process according to claim 33 wherein the working fluid comprises a refrigerant capable of undergoing a phase change within the desired thermal operating range.

56. A process according to claim 55 wherein the working fluid comprises Freon.

57. A process according to claim 55 wherein the working fluid comprises water.

58. A process according to claim 33 wherein the temperature of the vapor drops such that the expansion of vapor is completed in the low pressure cylinder before the third variable volume has expanded to a maximum by movement of the low pressure piston and further comprising a step of selectively exposing the third variable volume to the low pressure zone to prevent a vacuum from being drawn in the third variable volume.

59. A process according to claim 33 wherein the temperature of the vapor drops such that the expansion of vapor is completed in the low pressure cylinder before the fourth variable volume has expanded to a maximum by movement of the low pressure piston and further comprising a step of selectively exposing the fourth variable volume to the low pressure zone to prevent a vacuum from being drawn in the fourth variable volume.

60. A process according to claim 33 wherein the temperature of the vapor increases such that the expansion of vapor is limited in the low pressure cylinder and further comprising the step of selectively exposing the second and third variable volumes to the high and low pressure zones, respectively, to permit the required expansion of vapor discharged from the second to the third variable volumes.

61. A process according to claim 33 wherein the temperature of the vapor increases such that the expansion of vapor is limited in the low pressure cylinder and further comprising the step of selectively exposing the first and fourth variable volumes to the high and low pressure zones, respectively, to permit the required expansion of vapor discharged from the first to the fourth variable volumes.

62. A process according to claim 33 wherein mass flow of vapor is reduced during operation by extending the time that the first variable volume is in fluid communication with the high pressure zone and extending the time the fourth variable volume is in fluid communication with the low pressure zone prior to the transfer of mass flow from the first variable volume to the fourth variable volume.

63. A process according to claim 33 wherein mass flow of vapor is reduced during operation by extending the time that the second variable volume is in fluid communication with the high pressure zone and extending the time the third variable volume is in fluid communication with the low pressure zone prior to the transfer of mass flow from the second variable volume to the third variable volume.

64. A process according to claim 33 wherein the overall efficiency is at least about 90 percent as compared to a Carnot cycle.

65. A process for generating power comprising the steps of:

generating a superheated vapor with a temperature no greater than 400 degrees F. by heating condensed vapor from a low pressure zone in a superheating zone using a low grade heat source to cause the condensed vapor to undergo a phase change to saturated vapor during generally isobaric heat addition and thereafter increasing the heat content of the saturated vapor by exposing it to another heat source to form the superheated vapor;

supplying the superheated vapor to a high pressure zone thermally separated from the low pressure zone to maintain the vapor in the high pressure zone at a substantially constant high pressure of no more than 700 psig;

imparting work to a working shaft operably connected by a crank mechanism rotatable through 360 degrees to a high pressure piston by constantly exposing the lower face of the high pressure piston to the vapor in the high pressure zone while selectively exposing the upper face of the high pressure piston to the vapor in the high pressure zone as the high pressure piston approaches upper dead center in relation to the working shaft, said upper face of the high pressure piston forming a first variable volume with the high pressure cylinder wall;

concurrently therewith intermittently discharging vapor from the first variable volume to a larger second variable volume formed of the lower face of a low pressure piston linked directly to the high pressure piston and a low pressure cylinder wall while constantly exposing the upper face of the low pressure piston through low pressure vapor in a low pressure zone to thereby obtain a maximum pressure differential between the high and low pressure pistons and intermittently exposing the second variable volume to the low pressure zone, said second variable volume being allowed to increase more rapidly than the first variable volume decreases as the high and low pressure pistons move from bottom dead center to top dead center in relation to the working shaft, said working shaft operating at a rotational speed of no more than about 450 revolutions per minute; wherein high pressure vapor in the first variable volume generally undergoes an adiabatic isentropic expansion as the vapor is intermittently discharged from the first variable volume to the second variable volume and wherein vapor in the high pressure zone impacting the lower face of the high pressure piston performs a generally isobaric work process as the vapor is intermittently discharged from the first variable volume to the second variable volume;

intermittently discharging vapor from the second variable volume to the low pressure zone; and condensing discharged vapor from the second variable volume in the low pressure zone for recycle to the superheating zone.

* * * * *